US005941734A

United States Patent [19]

Ikeda et al.

[11] Patent Number: 5,941,734

[45] **Date of Patent: *Aug. 24, 1999**

[54] CONNECTOR

[75] Inventors: Koji Ikeda; Yoshihiro Tanigawa; Shinji Morino; Koji Yamashita; Hirohisa Okuno; Takao Sase; Masahiko Amano, all of Kadoma, Japan

[73] Assignee: Matsushita Electric Works, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,979

[22] Filed: Dec. 26, 1996

[30] Foreign Application Priority Data

| | | | |
|---|---|---|---|
| Dec. 25, 1995 | [JP] | Japan | 7-337575 |
| Dec. 25, 1995 | [JP] | Japan | 7-337576 |
| Dec. 25, 1995 | [JP] | Japan | 7-337578 |
| Jan. 26, 1996 | [JP] | Japan | 8-032772 |

[51] Int. Cl.[6] ..... H01R 23/02

[52] U.S. Cl. ..... 439/676; 439/941

[58] Field of Search ..... 439/676, 941, 439/404, 405

[56] References Cited

U.S. PATENT DOCUMENTS

| | | | |
|---|---|---|---|
| 5,362,257 | 11/1994 | Neal et al. | 439/941 |
| 5,586,914 | 12/1996 | Foster, Jr. et al. | 439/941 |
| 5,601,447 | 2/1997 | Reed et al. | 439/941 |
| 5,618,185 | 4/1997 | Aekins | 439/941 |
| 5,626,497 | 5/1997 | Bouchan et al. | 439/941 |
| 5,628,647 | 5/1997 | Rohrbaugh et al. | 439/941 |
| 5,639,266 | 6/1997 | Patel | 439/941 |

*Primary Examiner*—Gary F. Paumen

*Attorney, Agent, or Firm*—David B. Abel, Esq.; Graham & James LLP

[57] ABSTRACT

A connector A includes a plurality of conductors. Each conductor consists of a contact 1, a terminal piece member 2, and a connecting conductor 3 connecting the contact 1 with the terminal piece member 2. The conductors are respectively held on a body 10 of the connector. The connecting conductors 3 are arranged in three layers in such a position relationship that can prevent them from short-circuiting each other and also can prevent a crosstalk from being produced between them. In this structure, the connecting conductors 3 are arranged in two or more levels, which makes it easier for the connector to be designed for prevention of the crosstalk when compared with a structure in which the connecting conductors 3 are arranged in one plane.

14 Claims, 14 Drawing Sheets

CONNECTOR

BACKGROUND OF THE INVENTION

1. Field of the Invenntion

The present invention relates to a connector which is used mainly for signal transmission and can prevent generation of crosstalk.

2. Related Art

In recent years, the amount of information to be transmitted has been increasing rapidly in the field of electric communication and, therefore, high-speed signal transmission has been required. To make such high-speed transmission, it is necessary to use a signal of high frequencies. However, use of high-frequency signals increases the amount of a crosstalk between the signals due to the electrostatic coupling thereof. That is, in order to prevent the deteriorated quality of the signals, it is necessary to reduce the crosstalk amount and also, for execution of high-speed signal transmission, it is necessary to prevent the crosstalk not only in signal lines but also in connectors.

Now, a connector, which is generally used for communication, is structured such that two connector elements (a plug and a jack) are connected with each other. The two connector elements respectively include contacts to be connected with the contacts of the partner connector element, terminal piece members with which external electric wires (signal lines) can be connected, and connecting conductors for connecting internally the contacts with the terminal piece members, while these parts are all formed of conductors. In these conductors, there exist portions which are arranged in parallel to each other in a plane. In such parallel portions, since capacity components between the conductors that mutually transmit their partner's signals become unbalanced, a crosstalk current is caused to flow. Also, in the case of the contacts, the allocation of the kinds of signals and position relationship thereof are fixedly regulated by a standard and, therefore, the freedom of design thereof is low. That is, it is difficult to reduce the crosstalk amount in the contacts.

In view of the above, in the connector of this type, there is proposed a structure in which the connecting conductors are disposed in such a manner that, while the plug and jack are coupled to each other, the crosstalk between the terminal piece members of the mutually coupled plug and jack can be reduced. In this case, the connector used as the plug is smaller in dimension than the connector serving as the jack and thus it is difficult to change the arrangement of the connecting conductors of the plug side connector. Therefore, generally, for improvement in the crosstalk characteristic of the connector, the arrangement of the conductors is adjusted in the connector that is used as the jack. Also, as described above, because the contacts are restricted in the arrangement thereof and the terminal piece members are also low in the freedom of arrangement, there have been made trials to reduce the crosstalk by employing the arrangement of the conductors forming the terminal piece members.

For example, as shown in FIG. 9, an electric connector, which is disclosed in Japanese Patent Publication No. 6-84562 of Heisei, is a connector of an 8-pole modular jack type which includes contacts 1, terminal piece members 2 for connection with external electric wires, and connecting conductors 3 respectively interposed between the contacts 1 and terminal piece members 2, while the connecting conductors 3 are in part made to cross each other in two levels. In particular, where numerals (1)–(8) are respectively given to the contacts 1 in this order when viewed from the front surface of the connector (in FIG. 1, from the left side thereof), the connecting conductors 3, which are connected with three pairs of (1)(2) contacts 1, (4)(5) contacts 1 and (7)(8) contacts 1, are respectively made to cross in two levels. A main object of the present structure is to prevent a crosstalk between the pair of (3)(6) contacts 1 and the pair of (4)(5) contacts 1.

When various kinds of signal lines are to be connected by use of a single connector, preferably, the connecting conductors of the connector may be arranged in such a manner that they can prevent generation of the crosstalk between all signal lines. However, in the conventional connector having the above-mentioned structure, since the connecting conductors are all disposed on the same plane, the connecting conductors are also low in the freedom of design and thus it is difficult to design the arrangement of the connecting conductors in such a manner that generation of the crosstalk between all signal lines can be prevented.

On the other hand, in the above-mentioned structure, the connecting conductors 3 arranged substantially in a single plane are in part made to cross each other in a multiple level and, therefore, it is necessary to machine and bend the connecting conductors 3 in order that one of the connecting conductors 3 can cross over the other. Also, since the multi-level crossing portions of the connecting conductors 3 depend on the vertical position relationship between the connecting conductors 3, there arise restrictions on the assembling order of the conductors.

SUMMARY OF THE INVENTION

The present invention aims at eliminating the above drawback found in the conventional connector having the above-mentioned structure. Accordingly, it is an object of the invention to provide a connector which permits easy design that can prevent generation of the crosstalk.

Another object of the invention to provide a connector which eliminates the need for provision of the bent formed multi-level crossing portions in the connecting conductors and also prevents generation of a crosstalk, thereby being able to facilitate the manufacture of the connector and to reduce the restrictions on the connector assembling order.

In attaining the above object, according to the present invention, there is provided a connector which comprises a plurality of contacts to be electrically contacted with the contacts of a partner connector, a plurality of terminal piece members to be connected with external electric wires, a plurality of connecting conductors for electrically connecting mutually corresponding contacts and terminal piece members with each other, and a body formed of insulation material for holding the contacts, terminal piece members and connecting conductors thereon, while the connecting conductors are held on the body at least in two layers in such a manner that they are prevented from short-circuiting from each other and they are arranged in such a position relationship as to be able to prevent a crosstalk between them.

As described above, due to the fact that the connecting conductors are arranged in two or more layers, the freedom of the arrangement of the connecting conductors is enhanced and thus the connecting conductors to be moved near each other or to be separated away from each other can be arranged easily, which can facilitate such design of the arrangement of the connecting conductors that can prevent the crosstalk between them. Also, in the conventional structure, because the connecting conductors are arranged in a single surface, if crosstalk preventive measures are taken in the connecting conductors, then the whole of the connector is increased in width. On the other hand, if there is employed the structure of the invention, then the connecting conductors can be arranged in two or three levels for the crosstalk preventive measures and, therefore, the width dimension of the whole connector can be reduced over that of the conventional structure. That is, according to the present invention, not only the crosstalk can be prevented but also the size of the connector can be reduced.

According to the present invention, the contacts, terminal piece members and connecting conductors are formed by blanking metal plates.

According to the present structure, since the contacts, terminal piece members and connecting conductors are formed by blanking metal plates, there is eliminated a process for electrically connecting the contacts, terminal piece members and connecting conductors with one another, which not only can facilitate the manufacture of the connector but also can enhance the reliability thereof.

According to the present invention, terminal piece members and connecting conductors are formed by blanking metal plates separately according to the respective layers.

In the present structure, since the contacts, terminal piece members and connecting conductors are formed by blanking metal plates, there is eliminated a process for electrically connecting the contacts, terminal piece members and connecting conductors with one another, which not only can facilitate the manufacture of the connector but also can enhance the reliability thereof. Further, due to the fact that the patterns of conductors are formed by the respective layers, the conductors to be arranged in the same layer can be manufactured collectively with a layer as a unit and the conductors can be arranged on the body with a layer as a unit, which can further facilitate the manufacture of the connector.

According to the present invention, the connecting conductors belonging to the different layers are arranged in such a position relationship that can prevent them from crossing each other in two or three levels.

In the present structure, since the connecting conductors belonging to the different layers are arranged in such a position relationship that can prevent them from crossing each other in two or three levels, the connecting conductors may be arranged after they are mounted on the body according to the respective layers without considering the superimposing order of the layers, which can also facilitate the manufacture of the connector.

According to the present invention, since the external electric wires are respectively twisted pair wires and every pair of terminal piece members to be connected with its corresponding set of twisted pair wires adjoin each other, the positions of the terminal piece members with which the twisted pair wires are to be connected can be confirmed easily, which can facilitate the wire connecting operation. Also, due to the fact that every pair of terminal piece members adjoin each other for its corresponding pair of twisted pair wires, it is not necessary to separate the wires forming the twisted pair wires from each other in the end portions thereof, so that the twisted pair wires can be connected to the present connector without causing the characteristic impedances of the twisted pair wires to vary. That is, the deterioration of the transmission characteristic due to variations in the characteristic impedances of the twisted pair wires is hard to occur, variations in the transmission and crosstalk according to the construction conditions can be reduced, and there can obtained a stable transmission characteristic.

According to the present invention, at least one of the connecting conductors includes a detour portion which passes on the opposite side to the contacts with respect to the terminal piece members that are formed continuously with the remaining connecting conductors.

In the present structure, since at least one of the connecting conductors includes the detour portion, it is easy to arrange the terminal piece members in such a manner that they correspond to their associated pairs of twisted pair wires. That is, the contacts, terminal piece members and connecting conductors can be formed easily by blanking the metal plates and, in addition, the connecting conductors can be easily positioned in such a manner that they are prevented from crossing each other in two or three levels.

According to the present invention, each twisted pair wire consists of a pair of a color wire covered with an insulation cover colored in a single color and a white-base wire covered with an insulation cover colored in white and other color, while the connection relationship of the terminal piece members with the contacts is set such that the color wires and white-base wires are arranged alternately.

In the present structure, in addition to the fact that the terminal piece members are arranged in correspondence to every pair of twisted pair wires, the wires forming the twisted pair wires can be identified according to the colors of the respective colors, and, in the wire connected condition, the color wires and white-base wires are arranged alternately, which makes it possible to recognize the wrong connected wire at sight, if any. As a result, the possibility of occurrence of the wrong connected wire can be reduced.

According to the present invention, the connecting conductors belonging to the respective layers are formed in the same plane.

In the present structure, since the connecting conductors belonging to the respective layers are formed in the same plane, there is eliminated the need to form bent portions in the connecting conductors belonging to the same layer. As a result of this, the number of the bent formed portions can be reduced to thereby facilitate the manufacture of the connector.

In attaining the above object, according to the present invention, there is provided a connector which comprises: a plurality of contacts disposed substantially in parallel to each other so that they can be electrically contacted with contacts provided in a partner connector; a plurality of terminal piece members to be connected with external electric wires; a plurality of connecting conductors respectively extended from the contacts in a direction intersecting the longitudinal direction of the contacts for electrically connecting the contacts with the terminal piece members respectively; and, a body formed of insulation material for holding the contacts, terminal piece members and connecting conductors thereon, wherein the base portions of the contacts are arranged in two or more lines, and one of two or more contacts, which adjoin each other and the base portions thereof are arranged in mutually different lines, is connected with its associated connecting conductor through a detour portion passing on the opposite side to the terminal piece member with respect to the base portion of the other contact, whereby the above-mentioned two contacts and the connecting conductors respectively connected with the present two contacts are arranged in a mutually reversed order.

According to the above structure, since the base portions of the contacts are arranged in two or more line, the base portion of at least one contact is located at a position farther from the terminal piece members than the base portion of the other contact, with the result that the arrangement order of the contacts and connecting piece members can be reversed without causing the connecting conductors to cross each other in a multiple level. In other words, if a direction going from the terminal piece members to the contacts is defined as a forward direction, then the base portions of the contacts are arranged in front and rear lines. In this case, if the base portion of the contact arranged in the front line is connected with its associated connecting conductor via a detour portion which is so formed as to pass forwardly of the base portion of the contact arranged in the rear line, then the contacts and connecting conductors can be arranged in a reversed order without causing the connecting conductors to cross each other in a multiple level. Accordingly, a crosstalk current flowing to the other contact adjoining a set of conductors, in which the contacts and connecting conductors thereof are arranged in a reversed order, is 180° out of phase with a crosstalk current flowing to the connecting conductor to be connected with the present contact, so that the two crosstalk currents cancel each other to thereby be able to reduce the crosstalk amount. Further, since the connecting conductors are not caused to cross each other in a multiple level, not only there is eliminated the need to machine and bend them but also there arise no restrictions on the assembling order. That is, elimination of the need for execution of the bending operation facilitates the manufacture of the connector and no restrictions on the assembling order facilitates the connector assembling operation.

According to the present invention, the terminal piece members are arranged in two or more lines.

With employment of this structure, a dimension necessary for arrangement of a line can be reduced when compared with a structure in which the terminal piece members are all in a single line, which in turn makes it possible to reduce the width dimension of the body of the connector.

In attaining the above object, according to the invention, there is provided a modular jack, comprising: eight contacts disposed substantially in parallel to each other so that they can be respectively contacted with contacts provided in a modular plug; eight terminal piece members to be connected with external electric wires; eight connecting conductors extended in a direction intersecting with the extension direction of the contacts for electrically connecting the contacts with their corresponding electric terminal members; and, a body for holding the contacts, terminal piece members and connecting conductors thereon, wherein the base portions of the first, fourth and eighth ones of the contacts are positioned nearer to said terminal piece members than the base portions of the remaining ones of the contacts, and at least two of the first, third and fifth ones of the connecting conductors, or, at least two of the fourth, sixth and eighth ones of the connecting conductors are positioned near to each other.

According to the above structure, since the base portions of the first, fourth and eighth ones of the contacts are positioned nearer to said terminal piece members than the base portions of the remaining ones of the contacts, and at least two of the first, third and fifth ones of the connecting conductors, or, at least two of the fourth, sixth and eighth ones of the connecting conductors are positioned near to each other, in the other pairs than the third and sixth pairs, the arrangement of the contacts to be paired and the arrangement of the connecting conductors are reversed in order. Due to this, there is generated in the modular jack a crosstalk current which is 180° out of phase with a crosstalk current generated in the modular plug and, while the modular plug is connected with the modular jack, the two crosstalk currents cancel each other to thereby be able to reduce the crosstalk amount. Besides, since at least two of the first, third and fifth ones of the connecting conductors, or, at least two of the fourth, sixth and eighth ones of the connecting conductors are positioned near to each other, the intensity of the crosstalk current of the modular jack having a reversed phase can be set in such a level that can cancel the crosstalk current generated in the modular plug. Also, because the arrangement orders of the contacts and connecting conductors can be reversed without causing the connecting conductors to cross each other in a multiple level, it is not necessary to machine and bend the connecting conductors, and, due to the fact that the connecting conductors are not caused cross each other in a multiple level, there arise no restrictions on the assembling order. That is, elimination of the bending operation facilitates the manufacture of the modular jack, and no restrictions on the assembling order facilitates the assembling operation of the modular jack.

DETAILED DESCRIPTION OF THE PREFERRED EMBODIMENTS

Figure 4:
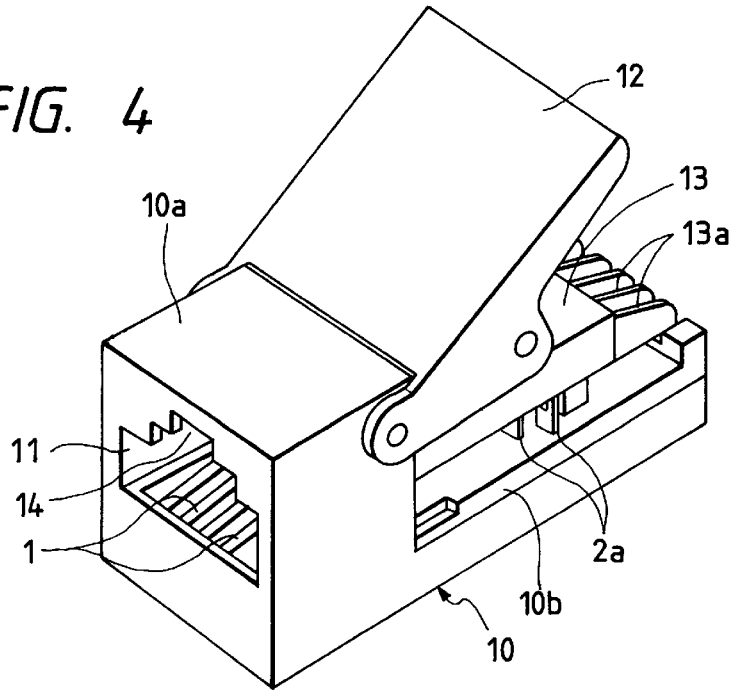
FIG. 4 is a perspective view of the embodiment.

Now, as an embodiment of the invention, there will be shown below a connector of a modular jack type. However, the invention is not limited to this embodiment but the technical idea of the present invention can also be applied to connectors of other types than the modular jack type. As shown in FIG. 4, the present connector is a modular jack of an 8-pole type and it comprises a body 10 which is formed of insulation material. The body 10 includes a connecting element 10*a* having an insertion opening 11 opened up in the front surface thereof, and a terminal base 10*b* formed continuously and integrally with the lower portion of the connecting element 10*a* and extended rearwardly thereof. One end portion of a lever 12 is pivotally mounted on the connecting element 10*a,* while the lever 12 can be opened and closed between a position to cover the upper surface of the terminal base 10*b* and a position to open the upper surface of the terminal base 10*b*. Also, a holding member 13 is disposed on the terminal base 10*b* such that it can be moved upward and downward and, in particular, the holding member 13 is connected with the lever 12 in such a manner that the holding member 13 can be moved upward and downward in linking with the opening and closing operation of the lever 12.

The connecting element 10*a* includes a connecting recessed portion 14, while the opening surface of the connecting recessed portion 14 provides a plug insertion opening 11. A connector of a modular plug type can be inserted into the connecting recessed portion 14 through the plug insertion opening 11. That is, on the connecting element 10*a* side, a plurality of (in the illustrated embodiment, 8 pieces of) contacts 1 are arranged in the connecting recessed portion 14 in such a manner that they are parallel to each other, while the contacts 1 can be elastically contacted and electrically connected with contacts provided in the connector of a modular plug type. Each contact 1 consists of a linear spring which is disposed such that it projects backwardly and upwardly from the front end portion of the connecting recessed portion 14. Also, on the terminal base 10*b,* there are erected a plurality of terminal piece members 2 which are electrically connected with the contacts 1, respectively. Each terminal piece member 2 includes a plate-shaped terminal piece 2*a* (see FIG. 2), while each terminal piece 2*a* includes a pressure contact slit 2*b* so formed that the upper end thereof is open. The terminal piece 2*a,* as known well, is structured such that, when an electric wire with an insulation cover is pressure inserted into the pressure contact slit 2*b* from the upper end thereof, the insulation cover is cut off with the two side edges of the pressure contact slit 2*b* and the core wire of the electric wire is held by and between the two side edges of the pressure contact slit 2*b*.

Figure 5:
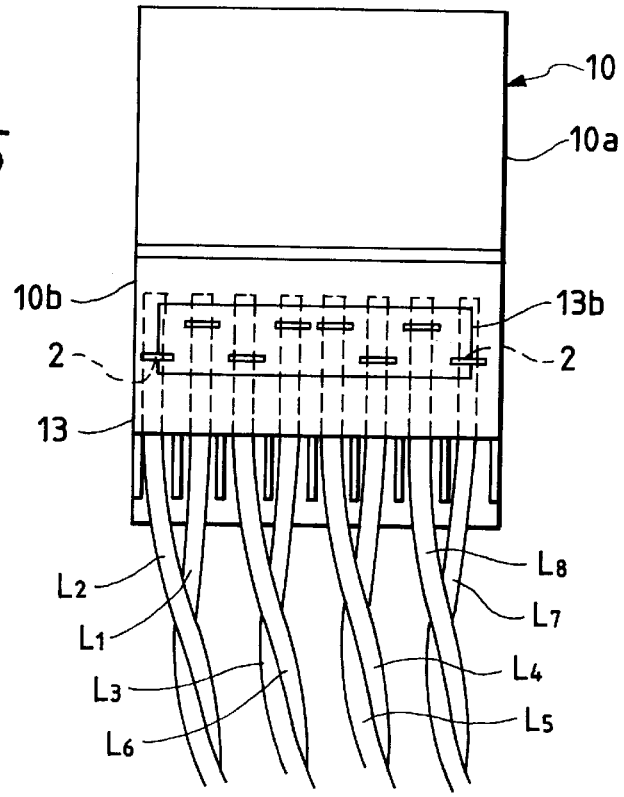
FIG. 5 is a plan view of the embodiment, in which a lever employed in the embodiment is removed.

On the other hand, the holding member 13 is formed hollow and, as shown in FIG. 5, it includes separation walls 13*a* in order that electric wires $L_1$–$L_8$ connected with the terminal pieces 2*a* can be held separately from each other. The holding member 13 includes an open window 13*b* formed in the portion thereof that corresponds to the terminal pieces 2*a*. That is, if the lever 12 is closed, then projections (not shown) provided on the lower surface side of the lever 12 can be pressed against the electric wires $L_1$–$L_8$ through the open window 13*b* to thereby be able to push the electric wires $L_1$–$L_8$ into their respective slits 2*b*.

Figure 1A:
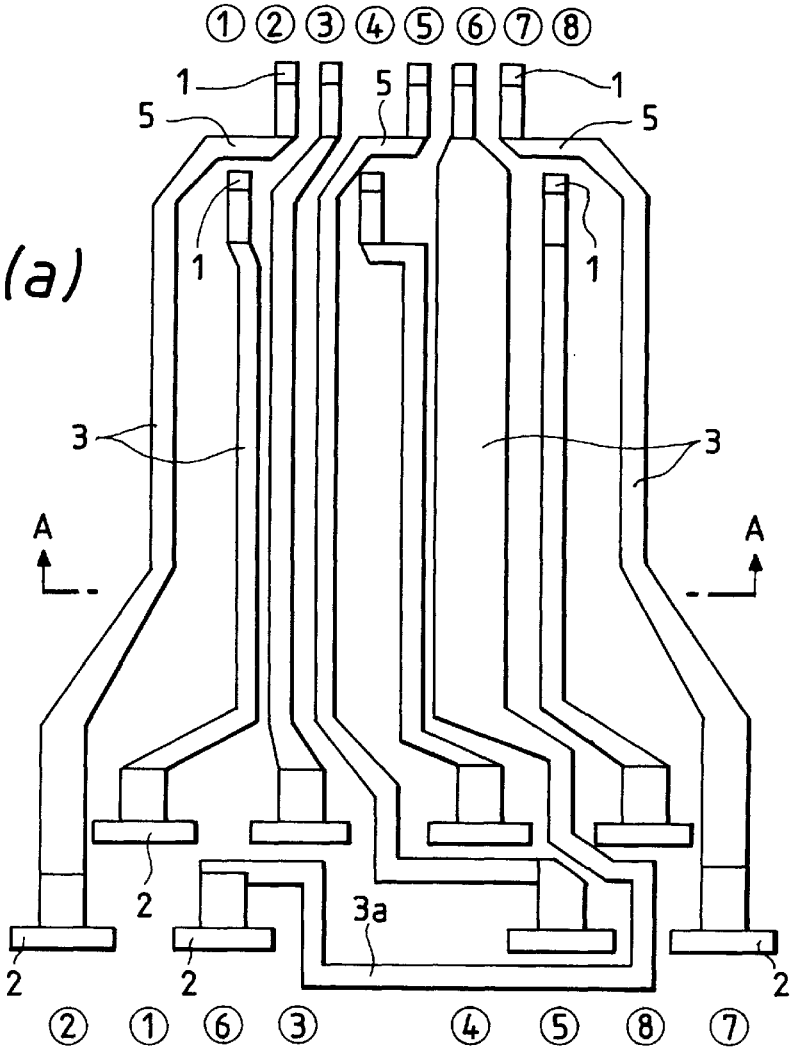
FIG. 1 shows an embodiment of a connector according to the invention and, in particular, FIG. 1 (*a*) is a plan view of the conductor portion of the embodiment, and FIG. 1 (*b*) is a section view taken along the line A—A shown in FIG. 1 (*a*)
Figure 1B:
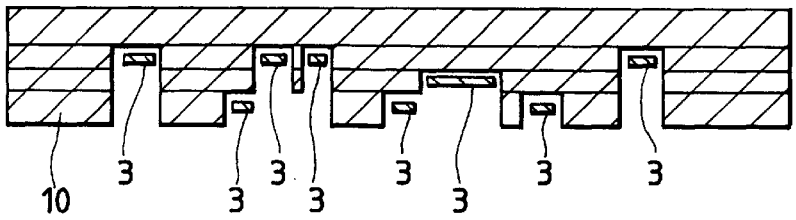

Now, the contacts 1 are respectively connected with the terminal piece members 2 in such a manner that they can have such a relationship as shown in FIG. 1 (in FIG. 1, the contacts 1 given numerals respectively enclosed with a circle are connected with the terminal piece members 3 given the corresponding numerals enclosed with a circle). Also, the terminal piece members 2 are arranged in such a manner that they are symmetric to each other with respect to a surface in the right and left direction. That is, two terminal piece members 2, which are arranged on the central side of the front line of the terminal piece members (in FIG. 1, upper line of the terminal piece members), are situated between two terminal piece members 2 which are arranged on the central side of the rear line of the terminal piece members; and, in the case of right and left terminal piece members with their symmetric surface between them, one terminal end piece 2 of the rear line is situated between the two terminal piece members 2 of the front line, while one terminal end piece of the front line is situated between the two terminal piece members 2 of the rear line. Since the eight terminal piece members 2 are arranged in this manner, when compared with a case in which the terminal piece members 2 are arranged in a single line, it is possible to reduce the right and left dimension that is necessary to arrange the terminal piece members 2. That is, the right and left width of the housing (body 10 and insertion body 20) can be reduced.

Provision of the eight terminal piece members 2 permits the connection of four pairs of twisted pair wires, while each pair of twisted pair wires are connected with the two terminal pieces members 2 which adjoin each other in the right and left direction. That is, two electric wires to be paired as a twisted pair cable are connected with the terminal piece member 2 situated on the left end of the rear line (in FIG. 1, lower line) and the terminal piece member 2 situated on the left end of the front line, another two electric wires to be paired as a twisted pair cable are connected with the two terminal piece members 2 respectively situated second from the left end of the rear line and situated second from the left end of the front line, and the remaining electric wires are similarly connected in such a manner that each pair of electric wires adjoin each other.

Figure 3A:
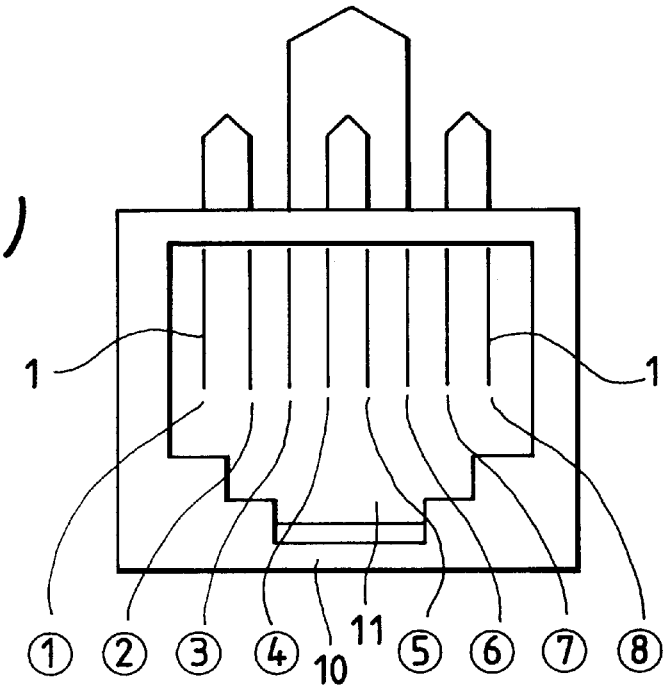
FIGS. 3 (*a*) and (*b*) are explanatory view of the arrangement of contacts employed in the embodiment.
Figure 3B:
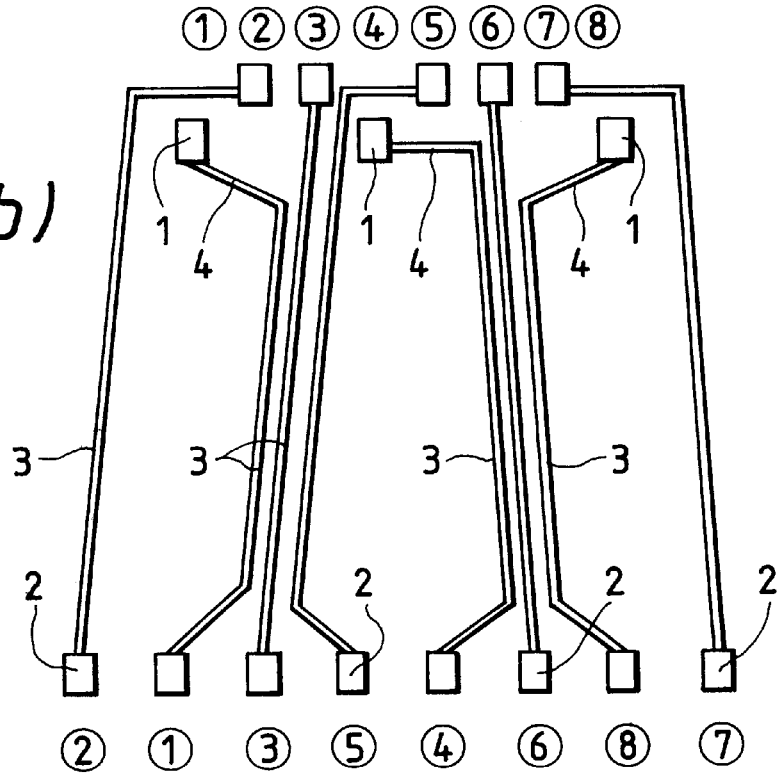

By the way, the wire connecting allocation of the contacts 1 is regulated by the ANSI/EIA/TIA-568 (Commercial building communication wire connection standard). In particular, as shown in FIG. 3 (*a*), in an arrangement in which the contacts 1 project downward from above when the plug insertion opening 11 is viewed from the front surface thereof, when terminal numbers are given in the order of (1)–(8) from left, the color codes of the electric wires to be electrically connected with the respective contacts 1 (1)–(8) are regulated in the following manner, for example ANSI/EIA/TIA568-B: that is, (1) white-orange, (2) orange, (3) white-green, (4) blue, (5) white-blue, (6) green, (7) white-brown, and (8) brown (what is represented by (white-X (X: orange, green, blue, brown) shows that white and X color are colored over the entire length of the contact). Also, the electric wires $L_1$–$L_8$ to be connected with terminal piece members 2 are respectively twisted pair wires, while the connection relationship between them is regulated in such a manner that the (1)(2), (3)(6), (4)(5), and (7)(8) contacts 1 are to be paired with each other. In other words, the wires to be paired to form a twisted pair cable consist of a twisted combination of a color wire covered with an insulation cover colored with a single color and a white-base wire covered with an insulation cover colored with white and other color and, as the other color than white in the white-base wire, there is employed the same color that of a color wire to be paired. For example, when the white-base wire is colored with white and green, a green wire is employed as the color wire to be paired. In addition to such regulation on the color codes of the electric wires, the crosstalk amount between the near ends of wires to be paired is also specified.

Here, the pair of (4)(5) contacts 1 are interposed between the pair of (3)(6) and, therefore, if the connecting conductors 3 are formed on the same plane, then a bridge circuit, which is formed by the capacity components between the respective connecting conductors 3, becomes unbalanced. That is, a crosstalk current is easy to flow between the pair of (4)(5) and the pair of (3)(6) and, especially when the frequencies of signals increase, the crosstalk current increases in amount. Also, in the remaining pairs of contacts 1 as well, as the signal frequency increases, the crosstalk amount increases.

Figure 2:
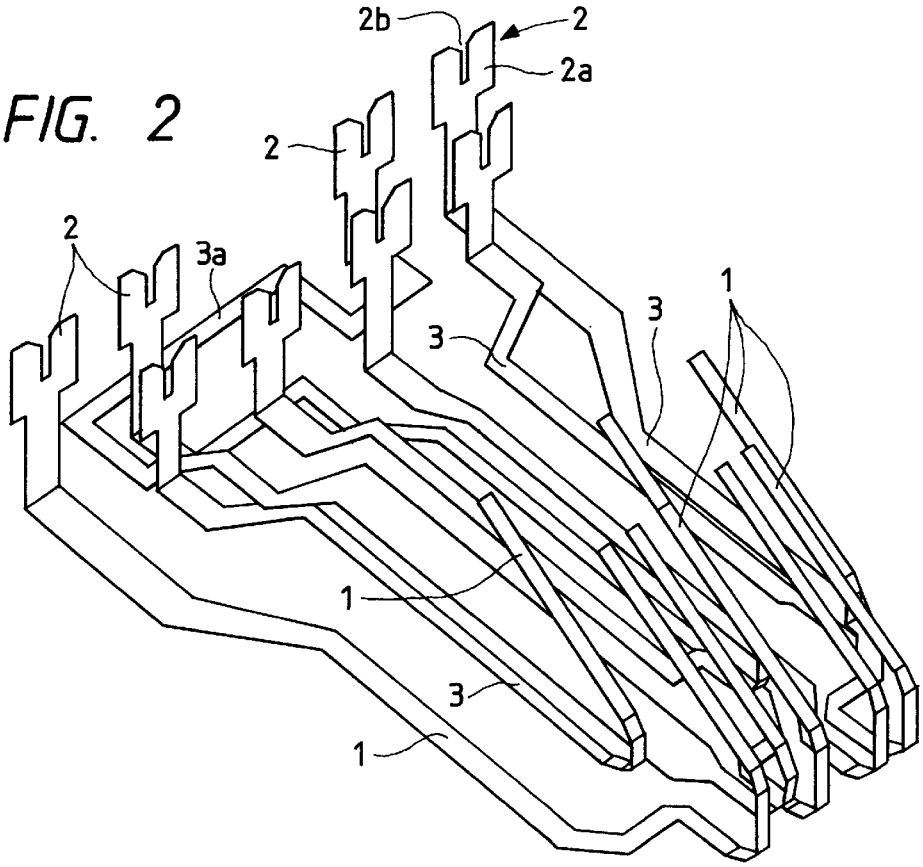
FIG. 2 is a perspective view of the above conductor portion.

As shown in FIGS. 1 and 2, the base portions of the contacts 1 are arranged in two front and rear lines. In particular, in the (1)(2), (4)(5), and (7)(8) pairs, the base portions of the one-side contacts ((2)(5)(7)) 1 are arranged in the front line, while the base portions of the other side contacts 1 are arranged in the rear line. Also, the base portions of the contacts ((2)(5)(7)) 1 arranged in the front line are connected with their respective connecting conductors 3 through their respective detour portions 5 which are respectively so formed as to pass in front of the contacts ((1)(4)(8)) 1 arranged in the rear line. Here, the extension direction of each contact 1 intersects with the extension direction of each connecting conductor 3 (see FIG. 2). Therefore, the contacts 1 and connecting conductors 3 can be arranged in the right and left reversed arrangement order without causing them to cross each other in a multiple level. In particular, the contacts 1 are respectively given the numbers (1) to (8) in this order from left in FIG. 1, as described above, whereas the connecting conductors 3 are arranged in the order of (2)(1)(3)(5)(4)(6)(8)(7). That is, in the respective pairs (1)(2), (4)(5), and (7)(8), due to provision of the detour portions 5, the contacts 1 and connecting conductors 3 are reversed in the right and left arrangement order thereof. For this reason, in these pairs, it is possible to reverse a relationship between the right and left arrangement of the contacts of a modular plug type connector, which is a partner connector of the present connector, to be contacted with the contacts 1 of the present connector and the right and left arrangement of the connecting conductors 3 of the present connector. As a result of this, in a state in which the partner connector is connected with the present connector, there is generated in the present connector an unbalance current which is 180° out of phase with an unbalance current which is generated in the partner connector untwisted parallel portion of the electric wire or the like. That is, the two unbalance currents cancel each other, so that the crosstalk amount can be reduced.

Also, the connecting conductors 3 connected with the (1)(3)(5) contacts 1 and the connecting conductors 3 connected with the (4)(6)(8) contacts 1 are positioned in such a manner that they are respectively near to each other. Due to this, it is possible to substantially strike a balance between the capacity components of the connecting conductors 3 in the respective pairs (1)(2), (4)(5), (3)(6) and (7)(8). By properly positioning the connecting conductors 3 near to each other in this manner, the intensity of the crosstalk current generated in the modular jack can be made almost equal to the intensity of the crosstalk current generated in the modular plug, so that the crosstalk amount can be reduced further.

In view of the above, the connecting conductors 3 for electrically connecting the contacts 1 with the terminal piece members 2 are arranged in three layers, and the width of the connecting conductors 3 and the clearances between the connecting conductors 3 are adjusted, thereby reducing the crosstalk amount. *For improvement in the crosstalk, there are available two methods: one is to change a gap defined between the conductors as near as possible to each other; and, the other is to change the width of the respective conductors.

To develop a small-size modular jack, it is desirable that not only a space necessary for arrangement of the conductors is reduced but also the characteristics of the conductors are improved.

In other words, if the capacitance component between the conductors (the whole crosstalk is improved by generating two kinds of crosstalks respectively having mutually reversed phases due to the capacitance coupling between the conductors) is adjusted properly not only by arranging the conductors as near as possible to each other but also by changing the width of the conductors, then the whole crosstalk characteristic can be improved while making effective use of the limited space.

In the high-frequency signal transmission, when the conductors are respectively assumed to form an electric circuit as a whole, the conductors are equivalently represented as the inductance and capacitance components of the electric circuit. As for the inductance components, the value thereof and mutual inductance thereof are determined mainly by the length of the conductor and a distance between the conductor and the other conductor, whereas the capacitance component depends mainly on the area (width and length) of the conductor, a distance between the conductor and the other conductor, and the area of the other conductor.

Therefore, if the length and width of the respective conductors as well as the distance between the conductors are set properly, then it is possible to improve the crosstalks to be generated in all combinations of the pairs of conductors.

As a means for improving the crosstalk in a space saving manner, there is available a means for changing the width of the conductors (because the length thereof is limited).

In the present invention, for example, the contacts (1)(4)(8) are arranged in a top layer, the contact (6) is arranged in a middle layer, and the remaining contacts are arranged in a bottom layer. Further, by changing the arrangement order of the connecting conductors 3 and the arrangement order of the contacts 1, the crosstalk amount is reduced (especially, contacts (1)(2) and (7)(8)), and, in order to be able to change the arrangement order of the connecting conductors 3 without causing them to intersect in the vertical direction, the positions of the connecting portions between the connecting conductors 3 and contacts 1 are shifted from one another. Actually, since the right and left clearances of the contacts 1 cannot be changed, by shifting the front and rear positions of the connecting portions (it is also possible to shift the upper and lower positions thereof), the arrangement order of the contacts 1 and connecting conductors 3 is changed. In particular, the positions of the connecting portions of the contacts (2)(4)(8) with the connecting conductors 3 are situated backwardly of the connecting portions of the remaining contacts 1 and, in the (2)(5)(7) connecting conductors 3, there are formed detour portions 3*a* which detour or pass in front of the connecting portions of the (2)(4)(8) contacts 1 and are connected to their respective contacts 1. Also, as described above, in order to connect the wires 2, which is to be paired with each other, to the mutually adjoining terminal pieces 2, the (6) connecting conductor 33 includes a detour portion 33*b* which detours or passes in the rear of the (3)(4)(5) contacts 1. In addition, as can be seen clearly from FIG. 1, in the respective pairs (1)(2), (3)(6) and (7)(8), since the right and left sides of the contacts 1 and connecting conductors 3 are reversed, in the present pairs, it is possible to reverse the relationship between the arrangement of the right and left sides of the contacts of the modular plug to be contacted with the contacts 1 and the arrangement of the right and left sides of the connecting conductors 3. As a result of this, in a state in which the modular plug is connected, there is generated in the connecting conductor 3 an unbalanced current which is 180° out-of-phase with an unbalanced current generated in the modular plug, and the two unbalanced currents cancel each other, thereby being able to reduce the crosstalk amount further.

The crosstalk amount can be reduced by the above-mentioned structure and, therefore, it is possible to provide a crosstalk restricting portion which can restrict the crosstalk amount without intersecting the conductors 3 in the vertical direction. In this manner, since the crosstalk amount can be restricted without crossing the conductors 3 vertically, there is eliminated the need for a bending operation to bend the conductors 30 for intersection thereof, which can facilitate the manufacture of the conductors 3.

In view of the above, according to the invention, as shown in FIGS. 1 and 2, the connecting conductors 3, which connect the contacts 1 with the terminal piece members 2, are arranged in three layers and the connecting conductors 3 are formed in a different shape from the conventional connecting conductors, so that not only the crosstalk amount can be reduced but also the wire connecting operation can be made easy.

Figure 6:
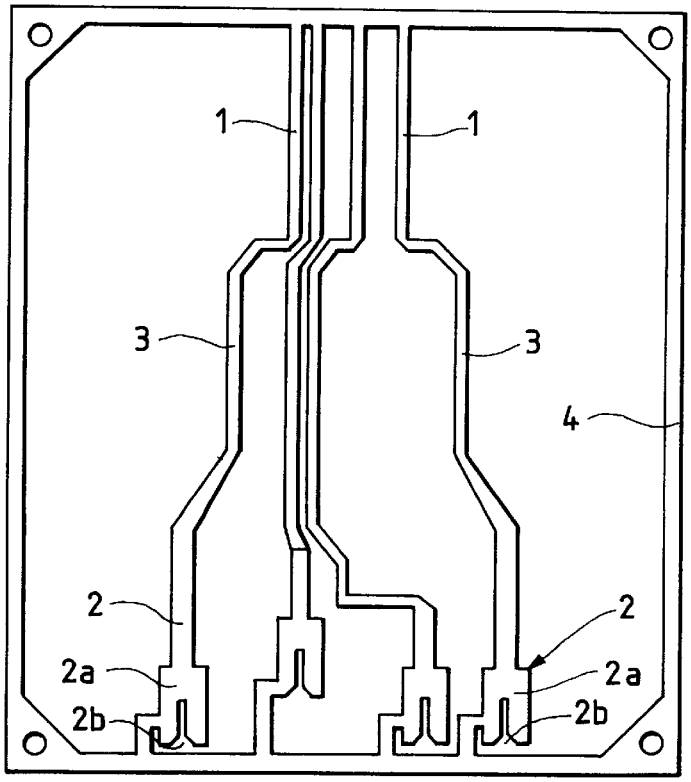
FIG. 6 is a plan view of a blanked pattern of a conductor portion used in the embodiment.
Figure 7:
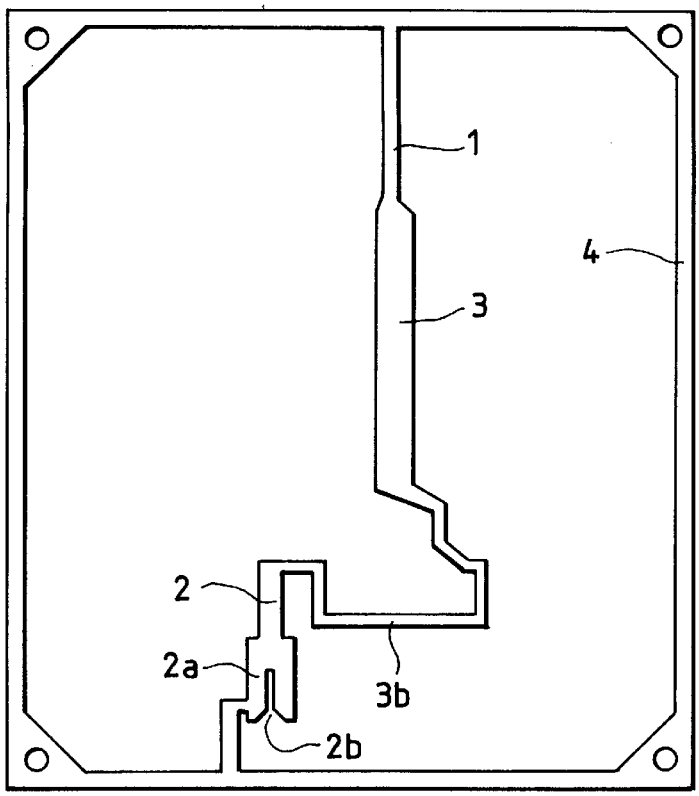
FIG. 7 is a plan view of a blanked pattern of a conductor portion used in the embodiment.
Figure 8:
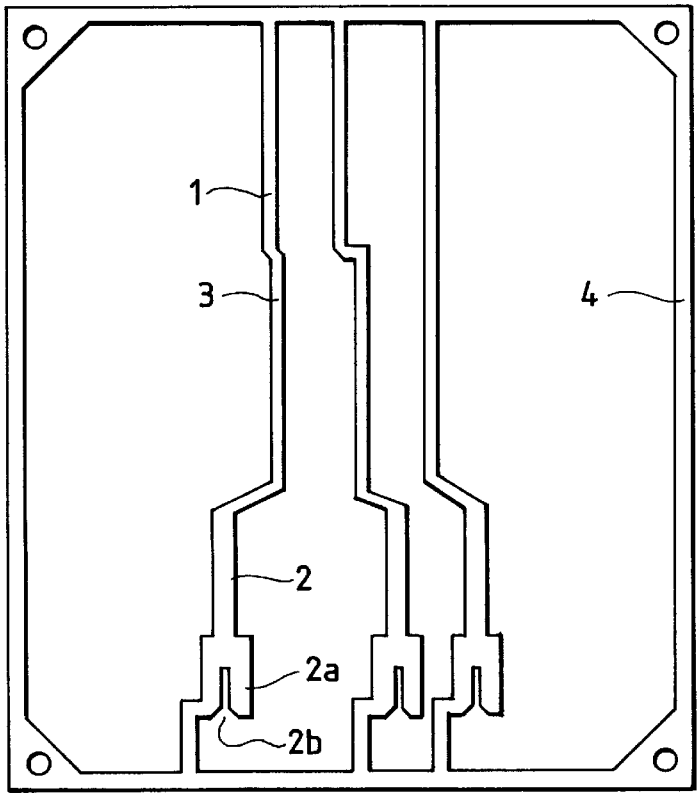
FIG. 8 is a plan view of a blanked pattern of a conductor portion used in the embodiment; and, FIG. 9 is an exploded perspective view of a conventional connector.
Figure 9:
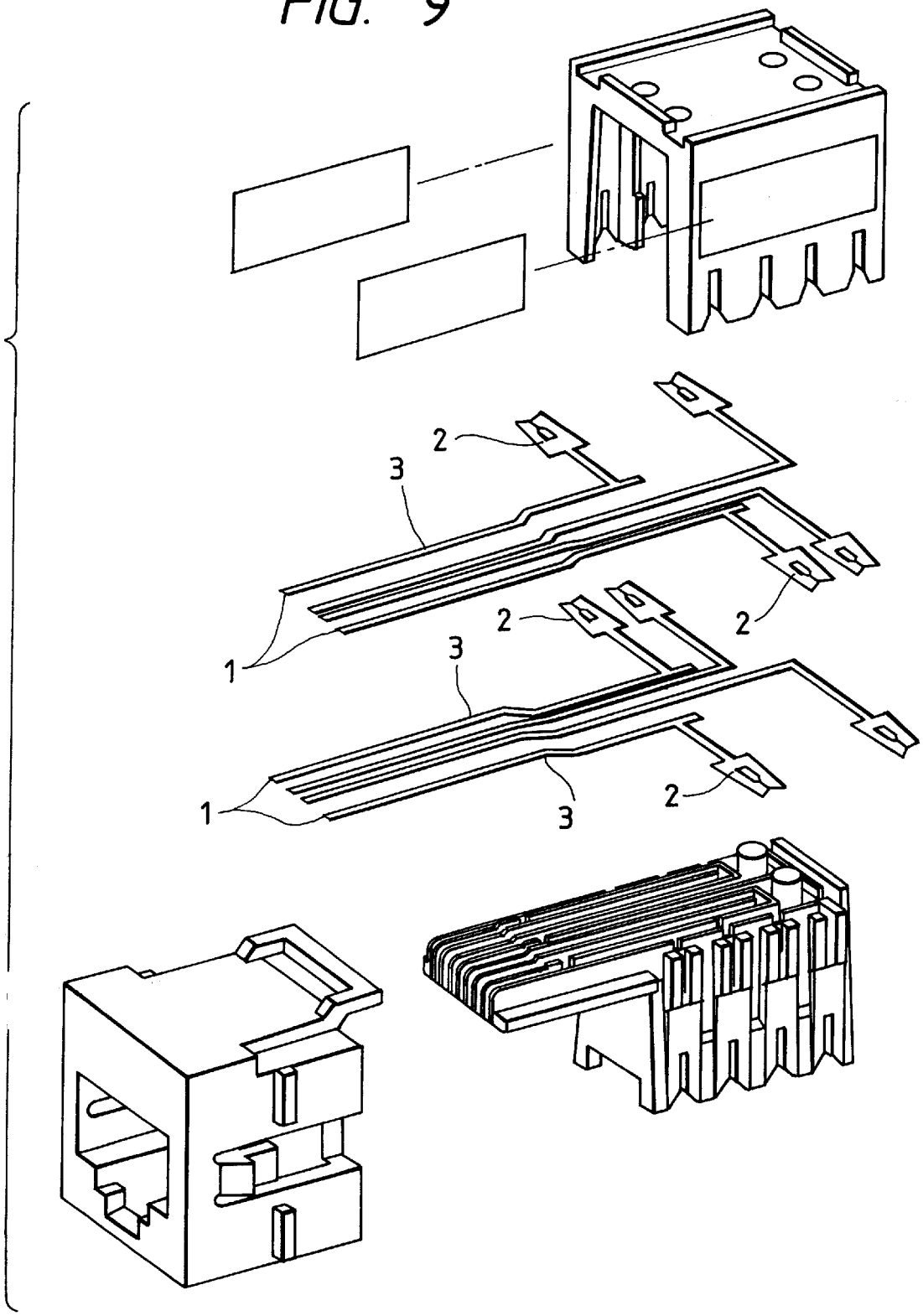

The contact 1, terminal piece member 2 and connecting conductor 3 are formed continuously and integrally in a lead frame by blanking a metal plate (alloy) having a thickness of the order of 0.4 mm. On the other hand, in the case where the connecting conductors 3 are arranged on the same layer, the contact 1, terminal piece member 2 and connecting conductor 3 are formed by blanking a single piece of metal plate. That is, by blanking three pieces of metal plates 4 respectively having such shapes as shown in FIGS. 6 to 8, the conductor portions of the connector corresponding to three layers can be formed. If the metal plates 4 are supplied as hoop members similarly when forming a lead frame for an integrated circuit, then the blanking operation can be carried out continuously.

The metal plates 4, which have been blanked and formed in the above-mentioned shapes, are mounted on the body 10 in such a manner that the three layers are superimposed on each other. Also, the contact is bent before the metal plates are mounted onto the body 10 or after the body 10 is formed. In this manner, since the bending operation is required only a little, the present connector machining operation is easy. Here, the conductor patterns to be formed on the respective metal plates 4 are formed in such a manner that, when they are mounted on the body 10 and the contacts 1 and terminal piece members 2 are bent, they do not cross each other in two or three levels. That is, the connecting conductors 3 except for a detour portion 3*a* for changing an arrangement of the terminal piece members 2 do not include any multi-level crossing portion whether they are viewed from above or from ahead (from right). Therefore, the respective metal plates 4 produce no other restrictions in the superimposition order thereof than a restriction that their superimposition order is set in consideration of the crosstalk characteristic. Also, since the connecting conductors 3 are so disposed as to be shifted in the thickness direction of the body 10, the freedom of design for the distance between the conductors and the dimension of the conductors is enhanced. This makes it possible to substantially strike a balance between the capacity components of the connecting conductors 3 to be paired, thereby leading to the reduced crosstalk amount. In other words, according to the present embodiment, not only the arrangement orders of the contacts 1 and connecting conductors 3 are reversed but also the connecting conductors 3 are arranged in a multiple level. Thanks to this, if the distances between the conductors and the lengths of the conductors are set properly, then the crosstalk can be prevented. Also, in the respective pairs (1)(2), (4)(5), and (7)(8), the right and left arrangements of the contacts 1 and connecting conductors 3 are reversed. Therefore, in these respective pairs, the relationship between the right and left arrangements of the contacts of the modular plug type connector, which is the partner connector of the present modular jack type connector, to be contacted with the contacts 1, and the right and left arrangements of the connecting conductors 3 of the present connector can be reversed. As a result of this, there is generated in the present connector an unbalance current which is 180° out of phase with an unbalance current generated in the partner connector, that is, the two unbalance currents cancel each other to thereby be able to reduce the crosstalk amount.

Further, the terminal piece members 2, as can be seen clearly from FIG. 1 (*a*), are arranged in the two front and rear lines. That is, the two terminal piece members 2 to be paired are arranged respectively in the front and rear lines. With employment of this arrangement, the front and rear terminal piece members 2 can be in part overlapped on each other in the right and left direction thereof. Thanks to this, when compared with a structure in which the terminal piece members 2 are all arranged in a single line, it is possible to reduce the right and left width of a space in which the terminal piece members 2 are disposed, thereby being able to reduce the width of the connector. Also, the front and rear terminal pieces 2*a* may be spaced apart from each other to such a degree that an insulation distance can be secured, and the respective terminal pieces 2*a* are small in thickness. Therefore, even when the terminal pieces 2*a* are arranged in the two front and rear lines, the front-and-rear direction dimension of the body 10 is not increased greatly.

Now, in the above-mentioned pairs (1)(2), (4)(5), and (7)(8), the connecting conductors 3 adjoin each other and thus the terminal piece members 2 can also be made adjoin each other. However, in the pair (3)(6), since the connecting conductors 3 of the (4)(5) pair exist between the connecting conductors 3 thereof, by providing a detour portion 3*a* in the connecting conductor 3 of (6), the two terminal piece members 2 are made to adjoin each other. That is, the detour portion 3*a* is formed in such a manner that it passes on the opposite side to the contacts 1 with respect to the terminal piece members 2 of the other pair ((4)(5) pair), whereby the terminal piece members 2 of the (3)(6) pair are allowed to adjoin each other. Also, the terminal piece members 2 are arranged in the order of (2) (1) (6) (3) (4) (5) (8) (7), so that the color wire and white-base wire of the pair wires to be connected with the terminal piece members 2 can be made to appear alternately. Due to use of this arrangement, the color wire and white-base wire to be paired can be connected with the mutually adjoining terminal piece members 2 and the color wire and white-base wire are arranged alternately, thereby being able to recognize the wrong connected wires visually and easily, with the result that the wrong connected wires can be reduced. This leads to the enhanced reliability of the connector construction. For reference, in FIG. 1, the right and left sides thereof can be replaced with each other and, therefore, in an embodiment where the right and left sides of the connector are reversed, the detour portion 3*a* may also be provided in the connecting conductor 3 of (3).

Figure 10A:
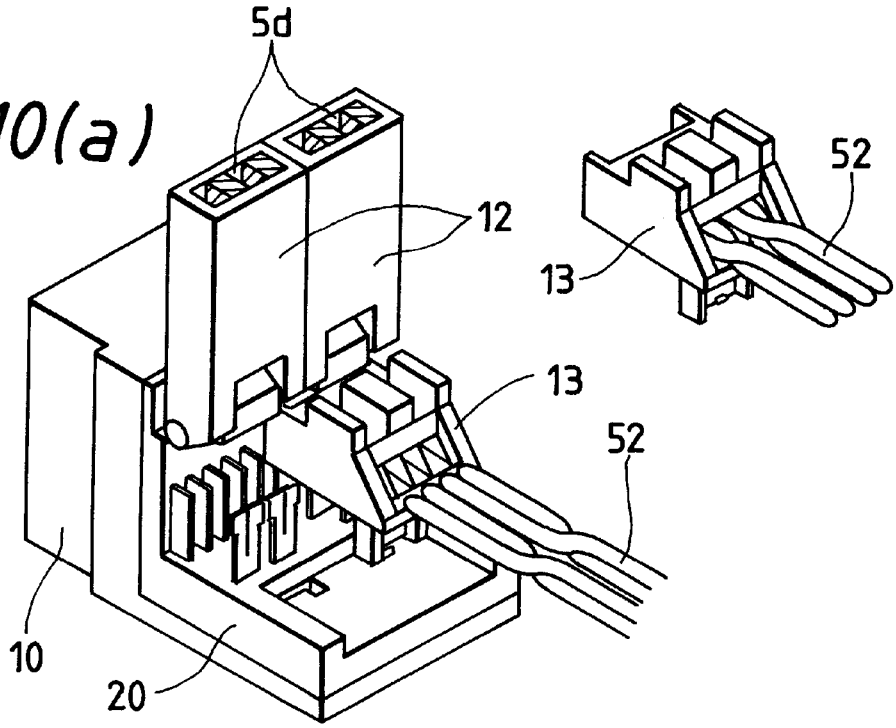
FIGS. 10 (*a*) and (*b*) are respectively perspective views of different modifications of the basic embodiment.
Figure 10B:
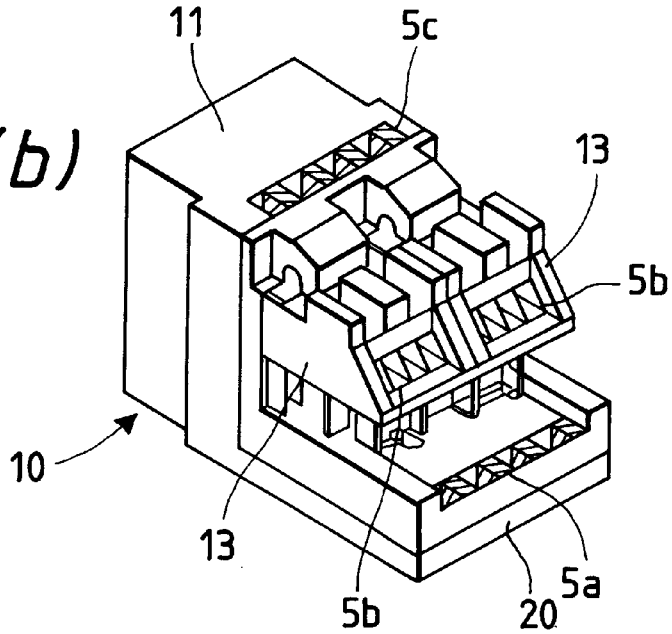

As described before, since there is previously determined the relationship between the arrangement order of the contacts 3 and the color codes of the insulation covers of the electric wires, the arrangement order of the terminal piece members 2 must be taken into account when the electric wires are inserted into the holding members 13. Therefore, it is desirable to provide color code displays which respectively display the color codes. As shown in FIG. 10, color code displays (for the convenience of illustration, they are shown by oblique lines but, actually, they are colored with colors which are coincident with the color codes of the electric wires 2) 5*a*–5*d* are provided at the positions that can be made to correspond to the electric wires. The positions that can be made to correspond to the electric wires 52 are, for example, the rear end portion of the insertion body 20, the rear end portion of the holding member 13, the upper surface of the body 10, the leading end face of the lever 12, and the like. If the color code displays 5*a*–5*d* are provided at any one of these positions, when the electric wires 52 are inserted into the holding member 40, simply by matching the colors displayed on the color code displays 5*a*–5*d* with the colors of the insulation covers of the electric wires 52, the wrong wire connection can be prevented. Here, the color code displays 5*a*–5*d* can be realized by printing colors directly on the above positions or by bonding labels to the above positions.

Figure 11:
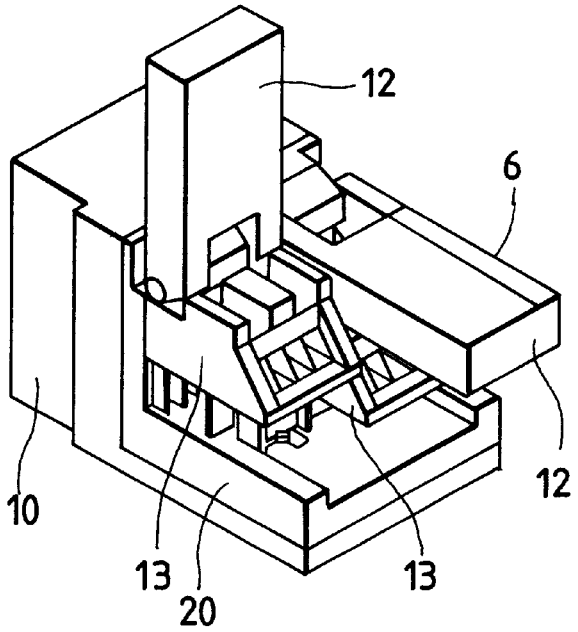
FIG. 11 is a perspective view of a modification of the basic embodiment.

Since the electric wires 52 are the twisted pair wires, when they are inserted into the holding member 40, they must be untwisted in the leading end portions thereof. However, if the untwisting dimension is larger than necessary, then the transmission characteristics of the electric wires 2 are caused to vary and, for this reason, the untwisting dimension must be the smallest necessary dimension. Also, because the four pairs of twisted pair wires are employed, if the respective pairs are different in the twisting dimensions thereof from each other, then the transmission characteristics thereof are ill affected. In view of this, in order to be able to provide an even untwisting dimension, there is provided a gauge 6 as shown in FIG. 11. The gauge 6 can be disposed in an arbitrary portion, for example, it can be disposed in any one of the lever 12, insertion body 20, holding member 40, and body 10. In the illustrated embodiment, the gauge 6 is disposed on the upper surface of one lever 12 and, in this arrangement, it is easy to understand the untwisting length of the electric wire 52 and the insertion lengths of the electric wires 52. This gauge 6 is formed simultaneously when the lever 12 is formed, and it is formed in a groove shape or in an embossed shape.

Figure 12:
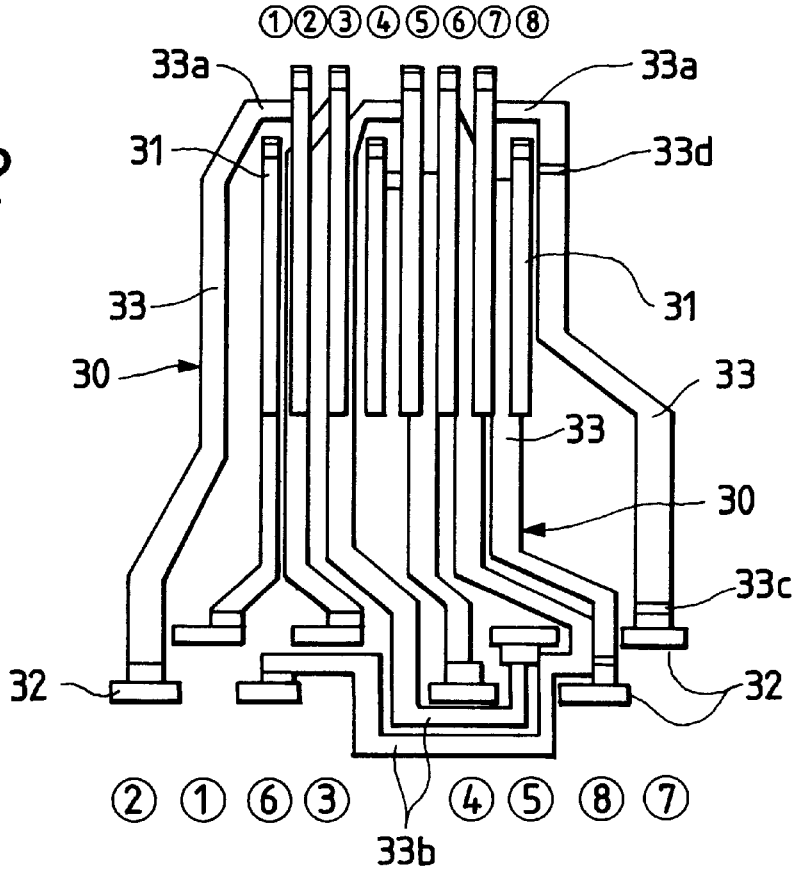
FIG. 12 is a view of the arrangement of conductors used in the basic embodiment.
Figure 13:
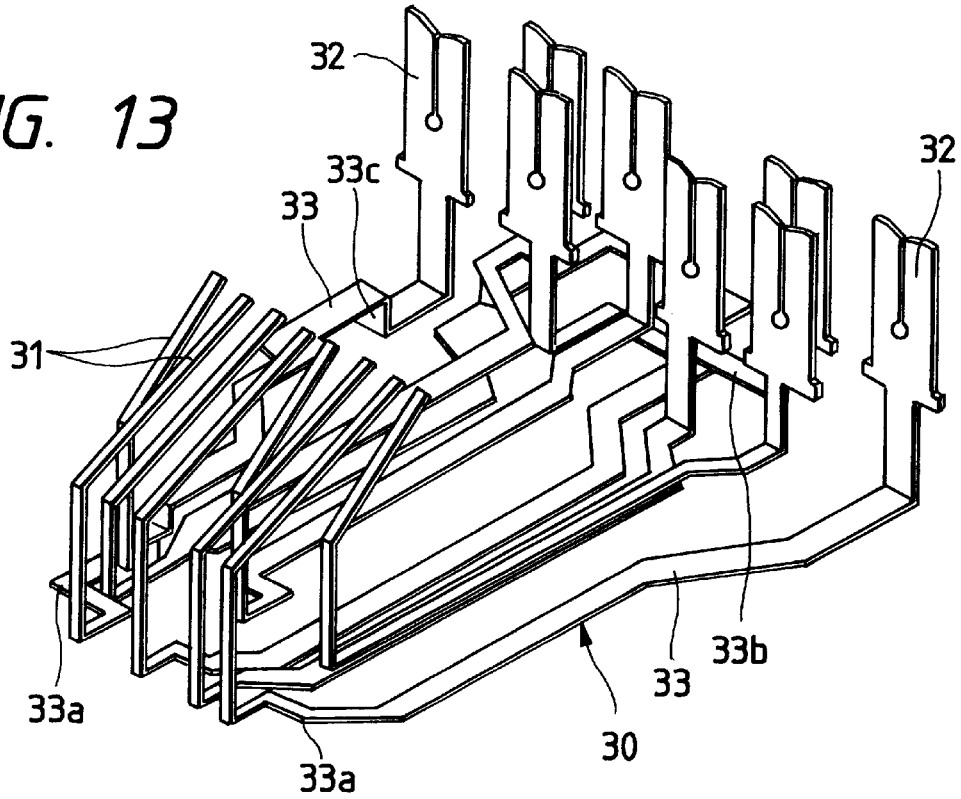
FIG. 13 is a perspective view of conductors used in the basic embodiment.

Now, the above-mentioned terminal piece members 2 are arranged in such a manner that they are symmetric in the right and left direction with respect to a surface. However, as shown in FIGS. 12 and 13, the terminal piece members 32 may also be arranged asymmetrically. Although the asymmetric arrangement is similar to the above-mentioned symmetric arrangement in that the terminal piece members 32 are arranged in two front and rear lines, it is different in that the terminal piece members 32 in the front and rear lines are arranged alternately in the right and left direction. That is, the terminal piece members 32 are arranged in a zigzag or cross-stitch manner. As the arrangement of the terminal piece member 32 is changed, the position relationship between the layers of the connecting conductors 33 as well as the positions of the detour portions 33*b* of the connecting conductors are changed. However, basically, the arrangement of the associated elements is similar to the arrangement shown in FIG. 1. Also, the arrangement order of the terminal piece members 32 with respect to the arrangement order of the contacts 31 in the present embodiment is also similar to that shown in FIG. 13. Here, a (7) connecting conductor 33 includes a stepped portion 33*c* which is formed in the neighborhood of its associated terminal piece member 32, while most of the intermediate portion of the (7) connecting conductor 33 provides an upper layer. In this manner, the (1)(4)(7) connecting conductors 33 provide an upper layer, the (6) connecting conductor 33 provides a middle layer, and the (2)(3)(5)(8) connecting conductors 33 provide a lower layer; and, in order that detour portions 33*a* respectively formed in the leading end portions of the (2)(5)(8) connecting conductors 33 can provide the same layer, there is formed a stepped portion 33*d* also in the leading end portion of the (8) connecting conductor 33.

Figure 14:
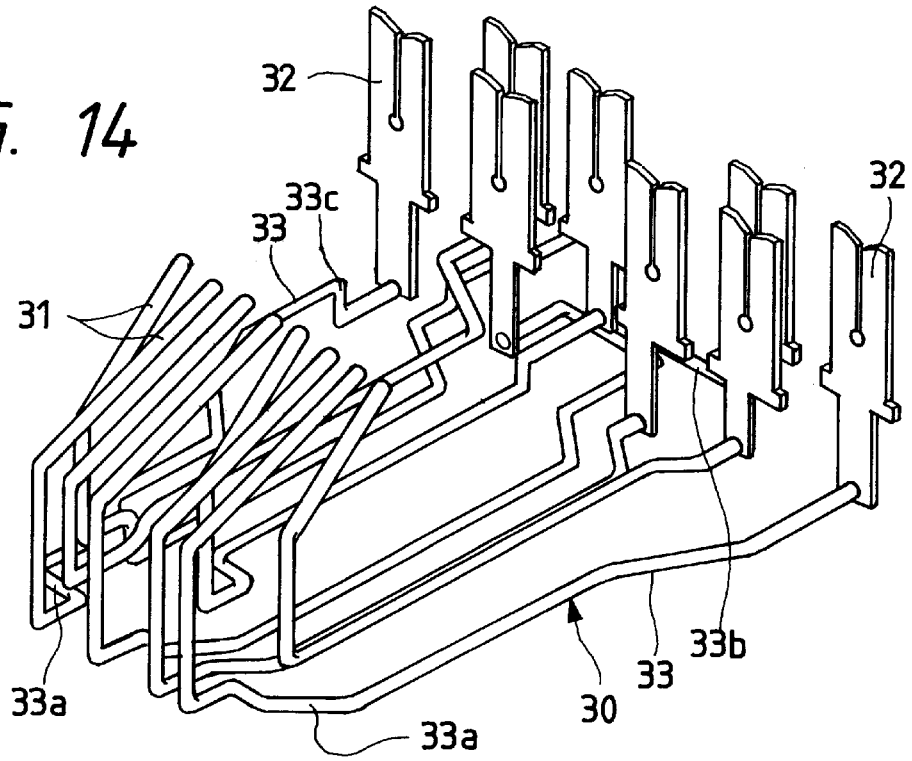
FIG. 14 is a perspective view of another embodiment of conductors used in the basic embodiment.
Figure 15:
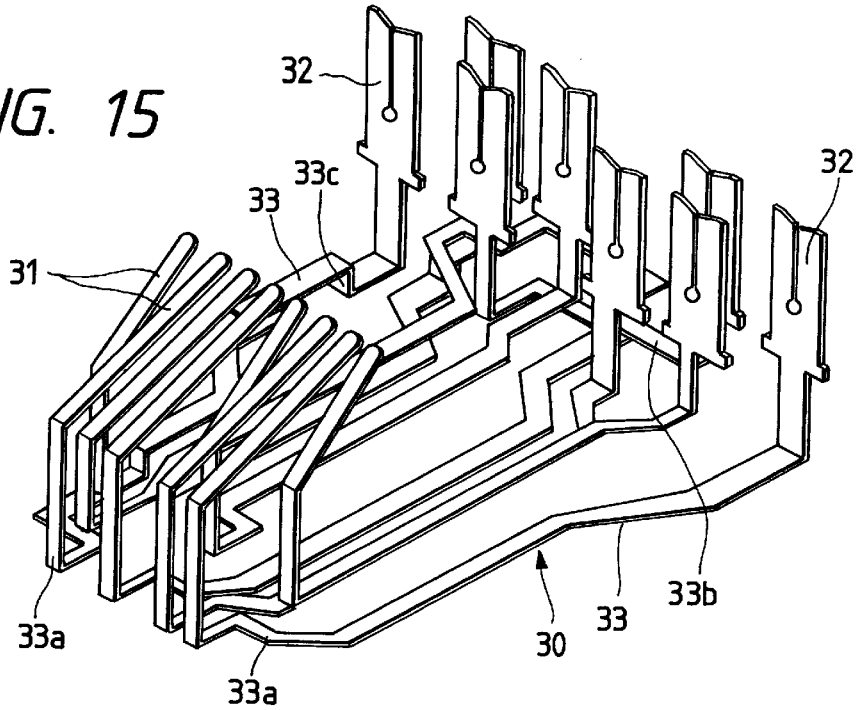
FIG. 15 is a perspective view of still another embodiment of conductors used in the basic embodiment.

The conductor 30 is not limited to the conductor that is formed by blanking a metal plate but, as shown in FIG. 14, the remaining portions of the conductor 30 except for the terminal piece member 32 can be formed of a wire member. Also, as shown in FIG. 15, only the contact 31 can be formed of a wire member, while the terminal piece member 32 and connecting conductor 33 can be formed of metal plates. In FIGS. 14 and 15, the portions given the same designations as in FIG. 13 have the same functions respectively.

Figure 16:
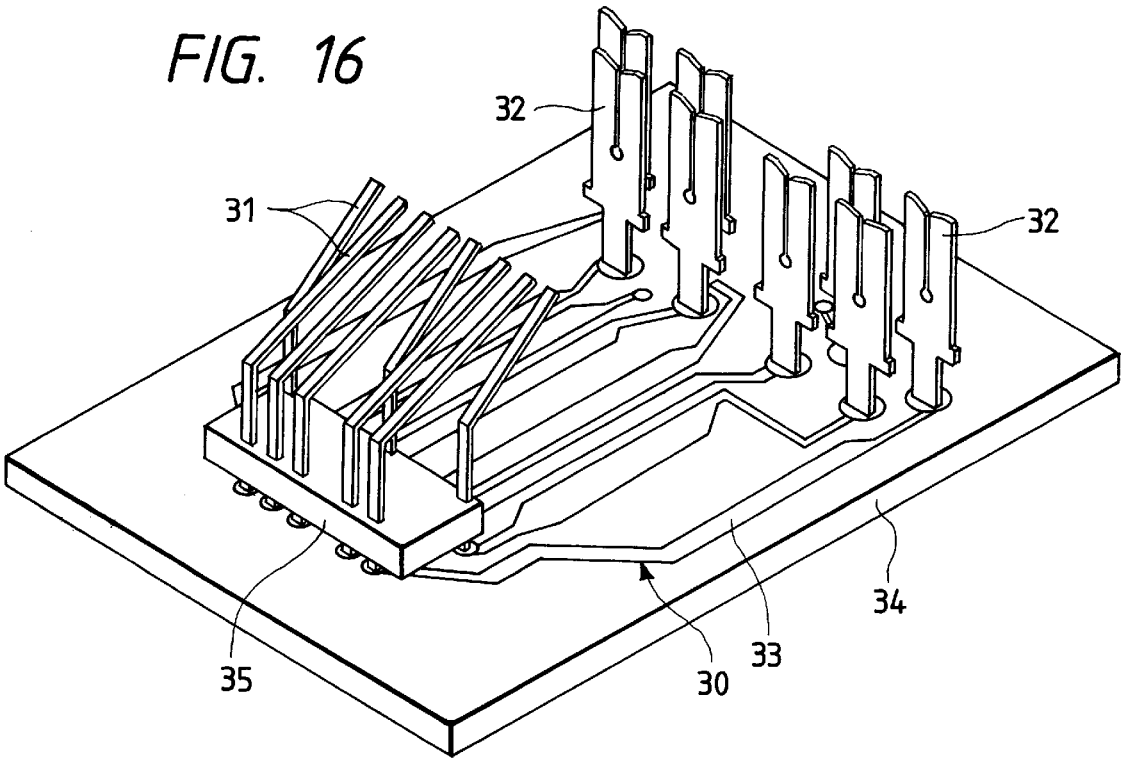
FIG. 16 is a perspective view of yet another embodiment of conductors used in the basic embodiment.
Figure 17:
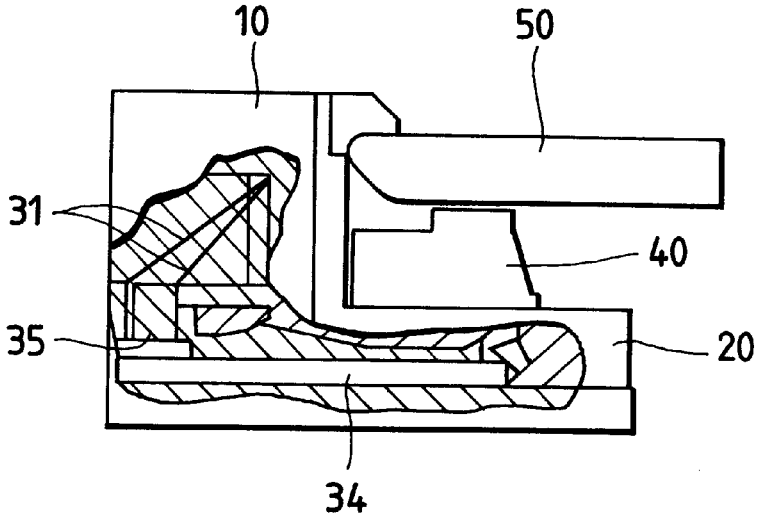
FIG. 17 is a partially broken side view of the basic embodiment.

In the above-mentioned conductors 30, the connecting conductors 33 are arranged in three layers. However, this is not limitative but, for example, it is also possible to employ an arrangement pattern or structure in which the connecting conductors 33 are arranged in a single plane while reducing the crosstalk amount. In this pattern, as shown in FIGS. 16 and 17, a printed circuit board 34 can be used, while conductive patterns formed in the printed circuit board 34 can be used as the connecting conductors 33. Also, the contacts 31 and terminal piece members 32 are respectively mounted on the printed circuit board 34. While the terminal piece members 32 are connected with and hold by the insertion body 20 as described before, the contacts 31 are not connected with the insertion body 20 and thus they can be easily bent in a condition that they are only fixed to the printed circuit board 34 by soldering. For this reason, there is provided a support body 35 which is formed of synthetic resin for supporting the base portions of the contacts 31, so that a plurality of contacts 31 are integrally connected together. Provision of the support body 35 increases the support strength of the contacts 31 to thereby prevent the contacts 31 from shaking unstably.

Figure 18:
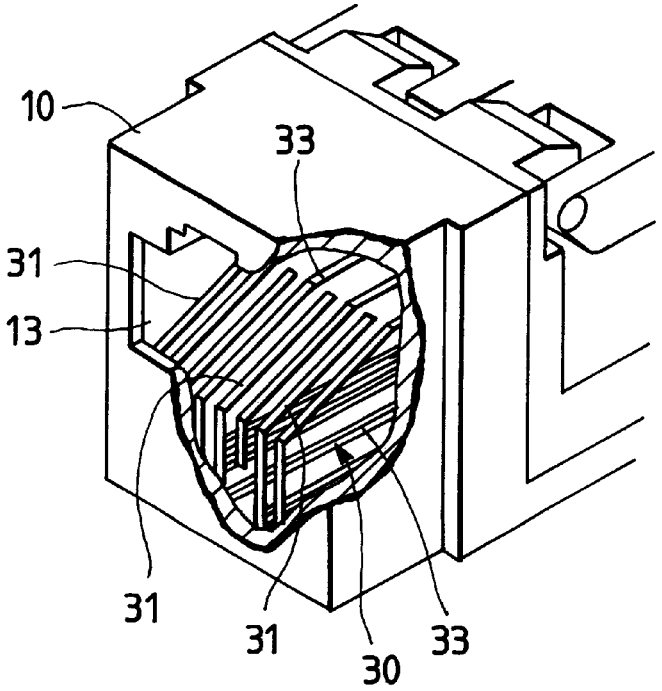
FIG. 18 is a partially broken perspective view of the basic embodiment.

In all of the above-mentioned embodiments, the conductor 30 is formed in a shape in which the contact 31 is extended obliquely backward from the leading end portion of the connecting conductor 33. However, this is not limitative but, for example, as shown in FIG. 18, the conductors 30 may also be formed such that some of the contacts 31 thereof are extended obliquely forward from the leading end portions of the associated connecting conductors 33. In this structure, the directions of the currents flowing in some of the contacts 31 can be reversed and the crosstalk current can be thereby made 180° out of phase with the modular plug, with the result that the crosstalk currents cancel each other to thereby be able to reduce the crosstalk.

Figure 19B:
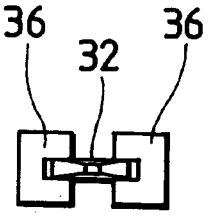
FIG. 19 shows a modification of a terminal piece member used in the basic embodiment; in particular, FIG. 19 (*a*) is a section view of the main portions thereof, and FIG. 19 (*b*) is a plan view of the main portions thereof.
Figure 19A:
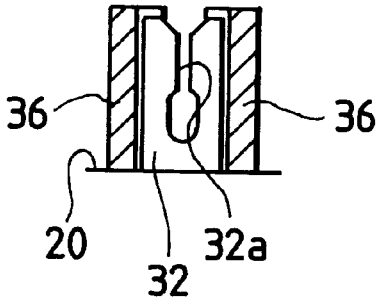
Figure 22:
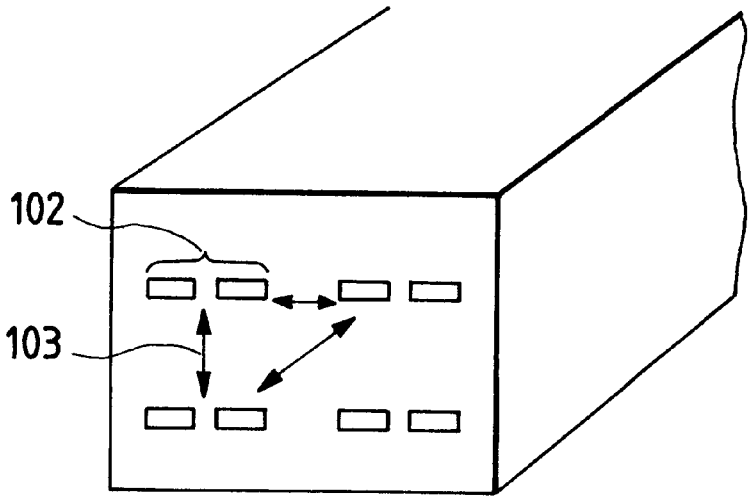
FIG. 22 shows another embodiment applied by the present invention.

When the electric wire 52 is pressure inserted into the pressure contact slit 32*a* of the terminal piece member 32, the terminal piece member 32 receives a pressing force and, in some cases, there is a possibility that the terminal piece member 32 can be given other components of the pressing force than the components thereof intersecting at right angles to the thickness direction of the terminal piece member 32. That is, in order to prevent the terminal piece member 32 from being deformed due to such components of the pressing force, the terminal piece member 32 may also be reinforced. For example, as shown in FIG. 19, in the portions of the insertion body 20 that correspond to the two side portions of the terminal piece member 32, there are erected deformation restricting ribs 36 each having a U-shaped section. The present deformation restricting ribs 36 not only are disposed at positions which does not interfere with the pressure insertion of the electric wire 2 into the pressure contact slit 32*a* of the terminal piece member 32, but also are arranged to reinforce the terminal piece member 32 such that they prevent the terminal piece member 32 against deformation even if a force having a component in the thickness direction of the terminal piece member 32 is applied to the terminal piece member 32. Here, the deformation restricting ribs 36 may also be disposed on the fixing member 40 side instead of the housing (insertion body 20) side.

Figure 20A:
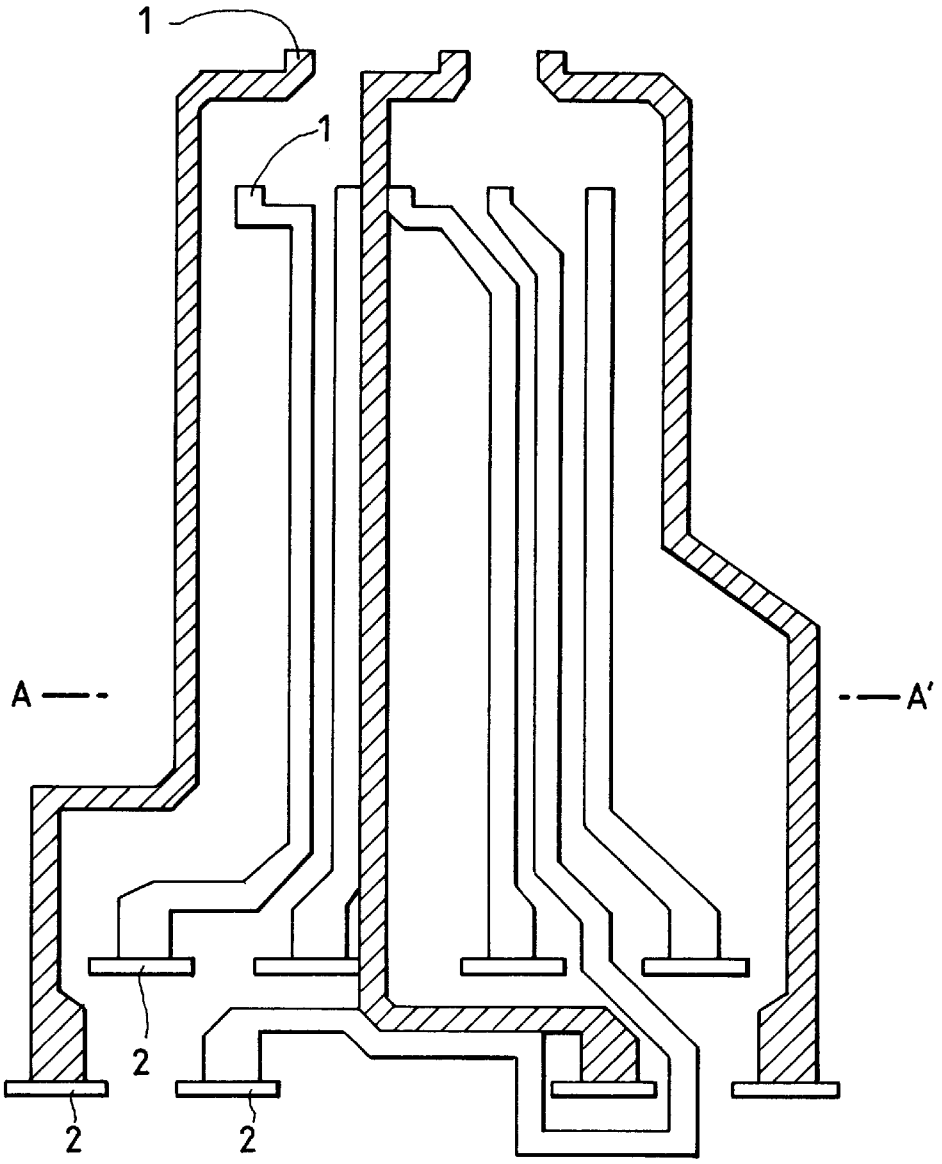
FIG. 20 shows another embodiment of a connector according to the invention and, in particular, FIG. 20 (*a*) is a plan view of the conduction portion of the embodiment, and FIG. 20 (*b*) is a section view taken along the line A—A shown in FIG. 20 (*a*)
Figure 20B:
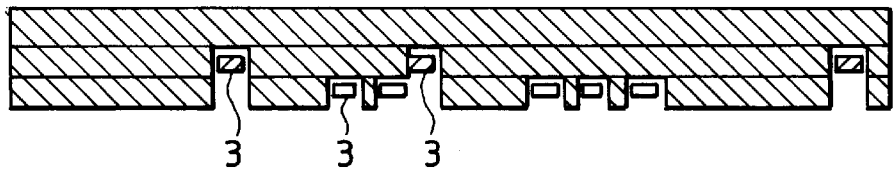
Figure 21A:
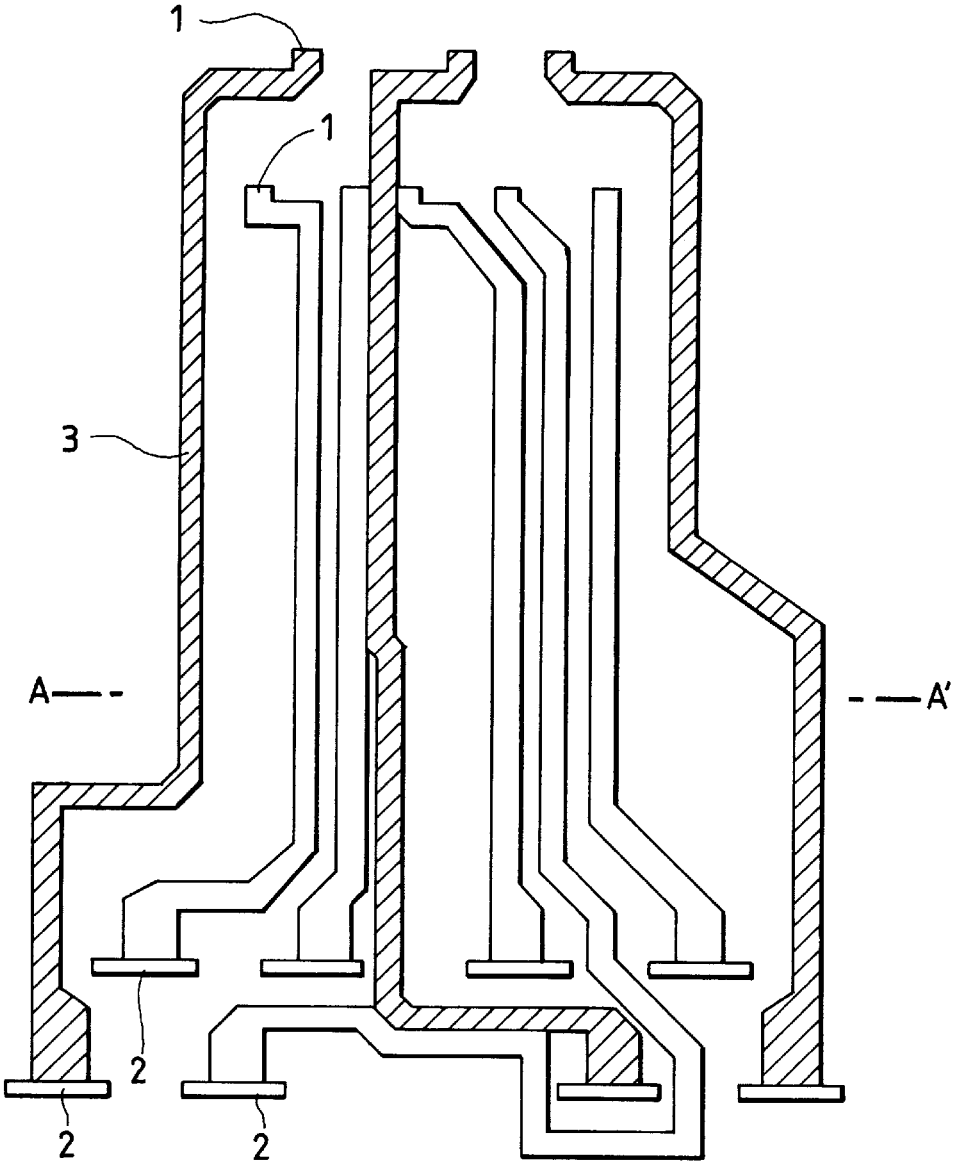
FIG. 21 shows another embodiment of a connector according to the invention and, in particular, FIG. 21 (*a*) is a plan view of the conduction portion of the embodiment, and FIG. 21 (*b*) is a section view taken along the line A—A shown in FIG. 21 (*a*)
Figure 21B:
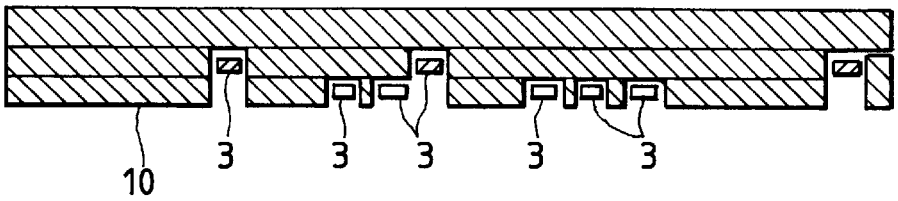

The embodiment described above employs the three layers structure. Of course, this invention is desigend to provide the two layers structure as shown in FIGS. 20 and 21.

Further, this invention is applicable for following structure:

An electric connector of a balanced transmission type including a plurality of conductors (for data transmission) which cause a troublesome crosstalk.

A connector of a 6-pin type (including a 6-pin/4-core-wire conductor, and a 6-pin/2-core-wire conductor) for use in a telephone or the like, RJ11 connector.

The invention can be applied not only to a lead frame type connector invented and disclosed in the present patent application but also to a connector of a type that a conductor pattern is formed on a substrate.

By the way, another embodiment will be described. An electric connector (of a balanced transmission type) adaptable for high-speed transmission speeds, such as an electric connector in which contact pins are arranged by pairs 102 or a distance 103 between the pairs is widely set. (For example, by pairs, wide distance) as shown in FIG. 21.

An electric connector of an unbalanced transmission oriented composite type such as an electric connector which includes a converter connector capable of conversion between balanced transmission and unbalanced transmission, or includes both a balanced transmission connector and an unbalanced transmission connector (which are positioned near to each other).

In the present invention, since the connecting conductors, which connect the contacts with the terminal piece members electrically, are held on the body at least in two layers in such a manner that they are prevented from short-circuiting from each other and they are arranged in such a position relationship as to be able to prevent a crosstalk between them, the freedom of the arrangement of the connecting conductors is enhanced and thus the connecting conductors to be moved near each other or to be separated away from each other can be arranged easily, which can facilitate such design of the arrangement of the connecting conductors that can prevent the crosstalk between them. Also, due to the fact that the connecting conductors are arranged in two or more levels in order to take the crosstalk preventive measures, the width dimension of the connector can be reduced. That is, the present structure is advantageous in that not only the crosstalk can be restricted but also the size of the connector can be reduced.

In the present invention, since the contacts, terminal piece members and connecting conductors are formed by blanking metal plates, there is eliminated the need for a process for electrically connecting the contacts, terminal piece members and connecting conductors with one another, which not only can facilitate the manufacture of the connector but also can enhance the reliability thereof.

In the present invention, since the contacts, terminal piece members and connecting conductors are formed by blanking metal plates, there is eliminated the need for a process for electrically connecting the contacts, terminal piece members and connecting conductors with one another, which not only can facilitate the manufacture of the connector but also can enhance the reliability thereof. Further, due to the fact that the patterns of conductors are formed by the respective layers, the conductors in the same layer can be manufactured collectively with a layer as a unit and the conductors can be arranged on the body with a layer as a unit, which can further facilitate the manufacture of the connector.

In the present invention, since the connecting conductors belonging to the different layers are arranged in such a position relationship that can prevent them from crossing each other in two or three levels, the connecting conductors may be arranged after they are mounted on the body according to the respective layers without considering the superimposing order of the layers, which can also facilitate the manufacture of the connector.

In the present invention, since the external electric wires are respectively twisted pair wires and every pair of terminal piece members to be connected with a set of twisted pair wires adjoin each other, the positions of the terminal piece members with which the twisted pair wires are to be connected can be confirmed easily, which can facilitate the wire connecting operation. Also, due to the fact that every pair of terminal piece members adjoin each other for its corresponding pair of twisted pair wires, it is not necessary to separate the wires forming the twisted pair wires from each other in the end portions thereof, so that the twisted pair wires can be connected to the present connector without causing the characteristic impedances of the twisted pair wires to vary. That is, the deterioration of the transmission characteristic due to variations in the characteristic impedances of the twisted pair wires is hard to occur, variations in the transmission and crosstalk according to the construction conditions can be reduced, and there can be obtained a stable transmission characteristic.

In the present invention, due to the fact that at least one of the connecting conductors includes a detour portion which passes on the opposite side to the contacts with respect to the terminal piece members formed continuously with the remaining connecting conductors, the terminal piece members can be easily arranged in such a manner that they correspond to the pairs of twisted pair wires.

In the present invention, since the terminal piece members are arranged in such a manner that the color wires and white-base wires of the twisted pair wires are arranged alternately, in the wire connected condition, the color wires and white-base wires are arranged alternately, which makes it possible to confirm the wrong connected wire at sight, thereby being able to reduce the possibility of occurrence of the wrong connected wire.

In the present invention, due to the fact that the connecting conductors belonging to the respective layers are formed in the same plane, there is eliminated the need to form bent portions in the connecting conductors in the respective layers, with the result that the number of bent machined portions is reduced to thereby be able to facilitate the manufacture of the connector.

According to the present invention, there is provided a connector which comprises: a plurality of contacts disposed substantially in parallel to each other so that they can be electrically contacted with contacts provided in a partner connector; a plurality of terminal piece members to be connected with external electric wires; a plurality of connecting conductors respectively extended from the contacts in a direction intersecting with the longitudinal direction of the contacts for electrically connecting the contacts with the terminal piece members respectively; and, a body formed of insulation material for holding the contacts, terminal piece members and connecting conductors thereon, wherein the base portions of the contacts are arranged in two or more lines, and one of two or more contacts, which adjoin each other and the base portions thereof are arranged in mutually different lines, is connected with its associated connecting conductor through a detour portion passing on the opposite side to the terminal piece member with respect to the base portion of the other contact, whereby the above-mentioned two contacts and the connecting conductors respectively connected with the present two contacts are arranged in a mutually reversed order. In the above structure, since the base portions of the contacts are arranged in two or more line, the base portion of at least one contact is located at a position farther from the terminal piece members than the base portion of the other contact, with the result that the arrangement order of the contacts and connecting piece members can be reversed without causing the connecting conductors to cross each other in a multiple level. In other words, if a direction going from the terminal piece members to the contacts is defined as a forward direction, then the base portions of the contacts are arranged in front and rear lines. In this case, if the base portion of the contact arranged in the front line is connected with its associated connecting conductor via a detour portion which is so formed as to pass forwardly of the base portion of the contact arranged in the rear line, then the contacts and connecting conductors can be arranged in a reversed order without causing the connecting conductors to cross each other in a multiple level. Accordingly, a crosstalk current flowing to the other contact adjoining a set of conductors, in which the contacts and connecting conductors thereof are arranged in a reversed order, is 180° out of phase with a crosstalk current flowing to the connecting conductor to be connected with the present contact, so that the two crosstalk currents cancel each other to thereby be able to reduce the crosstalk amount. Further, since the connecting conductors are not caused to cross each other in a multiple level, not only there is eliminated the need to machine and bend them but also there arise no restrictions on the assembling order. That is, elimination of the need for execution of the bending operation facilitates the manufacture of the connector and no restrictions on the assembling order facilitates the connector assembling operation. For example, if the conductor portion 3 are crossed with each other, the conductor insertion assembling order such that the conductor portion inserted into the recess provided in the body 10 is restricted b the crossed portion of the conductors. In contrast, according to the invention, since the connecting conductors are not caused to cross each other, there is increased the freedom of the conductor insertion assembling order.

According to the present invention, since the terminal piece members are arranged in two or more lines, a dimension necessary for arrangement of a line can be reduced when compared with a structure in which the terminal piece members are all in a single line, which in turn makes it possible to reduce the width dimension of the body of the connector.

According to the present invention, there is provided a modular jack, comprising: eight contacts disposed substantially in parallel to each other so that they can be respectively contacted with contacts provided in a modular plug; eight terminal piece members to be connected with external electric wires; eight connecting conductors extended in a direction intersecting with the extension direction of the contacts for electrically connecting the contacts with their corresponding electric terminal members; and, a body for holding the contacts, terminal piece members and connecting conductors thereon, wherein the base portions of the first, fourth and eighth ones of the contacts are positioned nearer to said terminal piece members than the base portions of the remaining ones of the contacts, and at least two of the first, third and fifth ones of the connecting conductors, or, at least two of the fourth, sixth and eighth ones of the connecting conductors are positioned near to each other. In the above structure, in the other pairs than the third and sixth pairs, the arrangement of the contacts to be paired and the arrangement of the connecting conductors are reversed in order. Due to this, there is generated in the modular jack a crosstalk current which is 180° out of phase with a crosstalk current generated in the modular plug and, while the modular plug is connected with the modular jack, the two crosstalk currents cancel each other to thereby be able to reduce the crosstalk amount. Besides, since at least two of the first, third and fifth ones of the connecting conductors, or, at least two of the fourth, sixth and eighth ones of the connecting conductors are positioned near to each other, the intensity of the crosstalk current of the modular jack having a reversed phase can be set in such a level that can cancel the crosstalk current generated in the modular plug. Also, because the arrangement orders of the contacts and connecting conductors can be reversed without causing the connecting conductors to cross each other in a multiple level, it is not necessary to machine and bend the connecting conductors, and, due to the fact that the connecting conductors are not caused cross each other in a multiple level, there arise no restrictions on the assembling order. That is, elimination of the bending operation facilitates the manufacture of the modular jack, and no restrictions on the assembling order facilitates the assembling operation of the modular jack.

What is claimed is:

1. A connector comprising:

a plurality of contacts to be electrically contacted with the contacts of a mating connector;

a plurality of terminal piece members to be connected with external electric wires to be adapted;

a plurality of connecting conductors electrically connecting mutually corresponding ones of the contacts and terminal piece members with each other; and a body, formed of insulation material, for holding said contacts, said terminal piece members and said connecting conductors, said connecting conductors being held on said body in at least two closely spaced parallel layers in a thickness direction, wherein said connecting conductors on said at least two closely spaced parallel layers are arranged and held on said body in a positional relationship so as to prevent any of said connecting conductors from crossing over any other of said connecting conductors, and wherein said connecting conductors in each layer lie in the same plane.

2. A connector as claimed in claim 1, wherein said external electric wires are respectively twisted pair wires and said terminal piece members are arranged in such a manner that every pair of terminal piece members to be connected with a corresponding set of twisted pair wires adjoin each other.

3. A connector as claimed in claim 2, wherein said twisted wires each consists of a pair of a first wire covered with an insulation cover colored in a first color and a second wire covered with an insulation cover colored in one of a second color, and said first color and said second color, and the connection relationship of said terminal piece members with said contacts is set such that said first wires and said second wires are arranged alternately.

4. A connector comprising:

a plurality of contacts to be electrically contacted with the contacts of a mating connector;

a plurality of terminal piece members to be connected with external electric wires to be adapted;

a plurality of connecting conductors electrically connecting mutually corresponding ones of the contacts and terminal piece members with each other, at least one of said connecting conductors including a detour portion which passes at least one terminal piece member on a side of said at least one terminal piece member opposite its corresponding contact; and a body, formed of insulation material, for holding said contacts, said terminal piece members and said connecting conductors, said connecting conductors being held on said body in at least two layers in a thickness direction.

5. A connector comprising:

a plurality of contacts to be electrically contacted with the contacts of a mating connector;

a plurality of terminal piece members to be connected with external electric wires;

a plurality of connecting conductors electrically connecting mutually corresponding ones of the contacts and terminal piece members of said plurality of contacts and terminal piece members with each other, each of said connecting conductors including a crosstalk restricting portion capable of reducing crosstalk between said plurality of connecting conductors, said crosstalk restricting portion being formed by providing a stepped portion having a level difference in a direction intersecting at right angles to an arrangement direction of said connecting conductors; and a body, formed of insulation material, for holding said contacts, said terminal piece members and said connecting conductors thereon, said connecting conductors being arranged in at least two closely spaced parallel layers and being held on said body in positional relationship so as to prevent any of said conductors from crossing over any other of said conductors, wherein said connecting conductors are held on said body in at least two layers in a thickness direction.

6. A connector as claimed in claim 5, wherein said crosstalk restricting portion is further formed by changing the width of said connecting conductor.

7. A connector as claimed in claim 5, wherein said crosstalk restricting portion is further formed by changing a gap between said connecting conductors.

8. A connector as claimed in claim 5, wherein said crosstalk restricting portion further includes a detour portion which is so detoured as to be able to change an arrangement order of said connecting orders with respect to the arrangement orders of said terminal piece members and said contacts.

9. A connector as claimed in claim 8, wherein said detour portion is so formed as to detour on the opposite side to the associated contact with respect to the remaining terminal piece members, or detour on the opposite side to the associated terminal piece member with respect to the remaining contacts.

10. A connector as claimed in claim 5, wherein said crosstalk restricting portion is formed in such a manner that one end side in the longitudinal direction of one of at least a pair of adjoining contacts is connected with its associated connecting conductor, and the other end side in the longitudinal direction of the other contact is connected with its associated connecting conductor.

11. A connector comprising:

eight contacts to be electrically contacted with the contacts of a mating connector, each of said contacts having a base portion;

eight terminal piece members to be connected with external wires to be adapted;

eight connecting conductors electrically connecting mutually corresponding ones of the contacts and terminal piece members with each other; and a body, formed of insulation material, for holding said contacts, said terminal piece members and said connecting conductors thereon, said connecting conductors being arranged in at least two parallel planes, each of said parallel planes defining a surface of the body on which at least one of said connecting conductors are disposed, wherein the base portions of the first, fourth and eighth ones of said contacts are positioned nearer to said terminal piece members than the base portions of the remaining ones of said contacts, and at least two of the first, third and fifth ones of said connecting conductors, or, at least two of the fourth, sixth and eighth ones of said connecting conductors are positioned adjacent to each other.

12. A connector comprising:

a plurality of contacts to be electrically contacted with the contacts of a mating connector, each of said contacts having a base portion;

a plurality of terminal piece members to be connected with external electric wires to be adapted;

a plurality of connecting conductors electrically connecting mutually corresponding ones of the contacts and terminal piece members with each other; and a body, formed of insulation material, for holding said contacts, said terminal piece members and said connecting conductors thereon, wherein the connecting conductors are arranged in at least two parallel planes, each of said parallel planes defining a surface on which at least one said plurality of connecting conductors are disposed, wherein the base portions of said contacts are arranged in two or more lines, and one of two or more contacts, which adjoin each other and the base portions thereof are arrange in mutually different lines, is connected with its associated connecting conductor through a detour portion passing on the opposite side to said terminal piece member with respect to the base portion of the other contact, whereby said two contacts and said connecting conductors respectively connected with said two contacts are arranged in a mutually reversed order.

13. A connector having a plurality of contacts disposed in a first arrangement order across a width of said connector and a plurality of terminal piece members, each corresponding to one of said plurality of contacts and being disposed in a second arrangement order across the width of said connector, said connector further comprising:

a plurality of connecting conductors electrically connecting said plurality of contacts to mutually corresponding ones of said plurality of terminal piece members so that said second arrangement order of said terminal piece members differs from said first arrangement order of said contacts and without any of said connecting conductors crossing any other of said connecting conductors.

14. A connector comprising:

a plurality of contacts being disposed in a first arrangement order across a width of said connector;

a plurality of terminal piece members being disposed in a second arrangement order across a width of said connector;

a plurality of connecting conductors electrically connecting said plurality of contacts to mutually corresponding ones of said plurality of terminal piece members such that said second arrangement order of said plurality of terminal piece members differs from said first arrangement order of said plurality of contacts, and wherein each of said connecting conductors is prevented from crossing any other of said connecting conductors; and a body, formed of insulation material, for holding said contacts, said terminal piece members and said connecting conductors.

* * * * *